US007900417B1

(12) United States Patent
Leines

(10) Patent No.: US 7,900,417 B1
(45) Date of Patent: Mar. 8, 2011

(54) PERGOLA HAVING POSTS, BEAMS, JOISTS, STRIPS, CLIPS, AND INTERNAL SUPPORT STIFFENERS

(76) Inventor: Richard Leines, Discovery Bay, CA (US)

( * ) Notice: Subject to any disclaimer, the term of this patent is extended or adjusted under 35 U.S.C. 154(b) by 858 days.

(21) Appl. No.: 11/112,224

(22) Filed: Apr. 22, 2005

Related U.S. Application Data

(60) Provisional application No. 60/564,108, filed on Apr. 22, 2004.

(51) Int. Cl.
*E04H 14/00* (2006.01)

(52) U.S. Cl. ..... 52/650.3; 52/653.1

(58) Field of Classification Search ..... 52/73, 74, 52/75, 78, DIG. 17, 79.1, 79.2, 79.4, 79.5, 52/79.6, 79.9, 79.11, 79.12, 79.13, 90.1, 52/92.1, 92.2, 289, 650.3, 653.1, 653.2, 655.1, 52/709, 711, 834, 650.1, 650.2, 843, 847
See application file for complete search history.

(56) References Cited

U.S. PATENT DOCUMENTS

| | | | | | |
|---|---|---|---|---|---|
| 1,586,053 | A | | 5/1926 | Snyder | |
| 3,040,849 | A | * | 6/1962 | Abberly | 52/834 |
| 3,266,635 | A | * | 8/1966 | McConnell | 211/191 |
| 3,331,170 | A | * | 7/1967 | Lowe et al. | 52/79.11 |
| 3,422,962 | A | * | 1/1969 | Burns et al. | 211/191 |
| 3,651,545 | A | | 3/1972 | Hara | |
| 3,721,056 | A | * | 3/1973 | Toan | 52/236.6 |
| 3,963,290 | A | * | 6/1976 | Rennemann | 312/321 |
| 3,999,351 | A | * | 12/1976 | Rensch | 52/648.1 |
| 4,272,930 | A | * | 6/1981 | Foster | 52/79.1 |
| 4,411,109 | A | * | 10/1983 | Struben et al. | 52/11 |
| 4,524,494 | A | | 6/1985 | Sato | |
| 4,541,214 | A | * | 9/1985 | Lambert | 52/473 |
| 4,545,159 | A | * | 10/1985 | Rizk | 52/79.9 |
| D293,934 | S | * | 1/1988 | Lambert et al. | D25/57 |
| 4,869,036 | A | * | 9/1989 | Peacock | 52/233 |
| 5,090,164 | A | * | 2/1992 | Mische | 52/90.1 |
| 5,185,972 | A | * | 2/1993 | Markiewicz | 52/63 |
| 5,236,625 | A | * | 8/1993 | Bardo et al. | 261/24 |
| 5,564,579 | A | * | 10/1996 | Pynenburg et al. | 211/189 |
| 5,758,987 | A | | 6/1998 | Frame | |
| 5,873,202 | A | * | 2/1999 | Parks | 52/73 |
| 5,906,084 | A | * | 5/1999 | Millington et al. | 52/650.3 |
| 6,135,425 | A | | 10/2000 | Platt | |
| 6,192,643 | B1 | * | 2/2001 | Zadok | 52/648.1 |
| 6,314,699 | B1 | * | 11/2001 | West | 52/489.1 |
| 6,345,484 | B1 | * | 2/2002 | Oliver et al. | 52/702 |
| 6,594,961 | B2 | * | 7/2003 | Leines | 52/650.3 |
| 6,754,992 | B1 | * | 6/2004 | Byfield et al. | 52/36.5 |
| 6,829,862 | B1 | * | 12/2004 | Skulsky | 52/95 |
| 2004/0016183 | A1 | * | 1/2004 | Hoffman | 52/64 |
| 2005/0081460 | A1 | * | 4/2005 | Davis | 52/169.9 |
| 2006/0096184 | A1 | * | 5/2006 | Kraaijkamp | 52/157 |
| 2007/0227080 | A1 | * | 10/2007 | Tseng | 52/78 |

FOREIGN PATENT DOCUMENTS

FR 2580695 A3 * 10/1986

* cited by examiner

*Primary Examiner* — Brian E Glessner
*Assistant Examiner* — Matthew J Smith

(57) ABSTRACT

A pergola system employs tap-lock pin (56) that readily attaches to a beam (82). The beam is encapsulated, preferably by vinyl extrusions, which allow horizontal strips to easily engage opposing end of the tap-lock pin (56). Clips (78) with protruding tap-locks (72) are secured to a substrate, allowing horizontal strips with ledges (96) to be engaged with the protruding tap-locks (72) to provide an easily installed pergola shade structure. A shroud (102) or coupler (62) allows expansion so that a plurality of pergola kits can be assembled together and so that a homeowner or do-it-yourselfer can install, alter, or retrofit the pergola(s) with minimal effort and direction.

6 Claims, 17 Drawing Sheets

PERGOLA HAVING POSTS, BEAMS, JOISTS, STRIPS, CLIPS, AND INTERNAL SUPPORT STIFFENERS

CROSS-REFERENCE TO RELATED APPLICATIONS

This patent is based upon an application that claims priority of Provisional Patent Application Ser. No. 60/564,108, Filed Apr. 22, 2004.

BACKGROUND

1. Field

This application relates to building structures, specifically to an easily installed user-friendly assembly system which combines substructures or substrates and building components to form a shade or activity structure.

2. Prior Art

Usually an outdoor shade or activity structure is constructed of horizontal and vertical wood members which are fastened together with nails or bolts and nuts. Common names of these structures are pergolas, arbors, trellises, gazebos, overheads, lath houses, bowers, armadas, awnings, porticos, and greenhouses, as well as others. Such shade structures (hereinafter pergolas) are exposed to the environment and often need regular annual maintenance that is costly as well as a nuisance.

Plastic, wood, composite, and metal materials, for example, have been used in the past for the construction of pergolas, but the method of connection and layout requirements of such pergolas increase the difficulty for a proper and user-friendly assembly. Previous structures took a long time to install with quality structural components. Also the components did not attach sequentially and uniformly.

U.S. Pat. No. 1,586,053 to Snyder (1926) shows a metal beam with a groove configuration where a bolt can be slid down the groove and a wood board can be attached for construction purposes. This arrangement is very limited due to its archaic bolt-using installation approach, which is complicated and thereby increases the ever escalating cost of construction projects.

U.S. Pat. No. 4,541,214 to Lambert (1985) shows a pergola with a top comprising wood strips aligned in parallel with a bottom planar face fastened together with nails. The wood and nail fastening system has obvious ongoing maintenance problems, often leading to dry-rot and replacement. Also it does not provide an accurate method for placement and attachment of parts.

U.S. Pat. No. 3,651,545 to Hara (1972) shows a binding device for fastening two plates together but has little binding capability due to its apparent shape.

Other existing pergolas with structural components and connectors suffer from a number of other disadvantages:

(a) They are difficult to install and erect.

(b) They use archaic fastening methods, so preciseness of layout was not possible.

(c) Previous structural stiffeners did not incorporate a straightforward approach for interconnecting the parts.

Insofar as I am aware, all existing pergola systems are so difficult to assemble that most residential home owners cannot install them in an affordable, efficient manner without professional help.

BACKGROUND ADVANTAGES

Accordingly, several advantages of one or more aspects are:

(a) to provide an improved pergola and pergola construction system, (b) to provide a pergola that does not have on-going maintenance problems, (c) to provide a pergola system where nails are not needed as fasteners, (d) to provide structural members that are less complicated for installation purposes, (e) to provide a pergola that is cost effective in reducing the ever escalating cost of construction projects, (f) to provide a binding device that fastens its parts together securely with superior binding capability, (g) to provide a pergola where dry-rot and replacement of parts due to dry-rot are eliminated.

Further objects and advantages are to provide:

- a kit system which incorporates simplicity in all its parts for a user-friendly affordable building structure that is easy to install due to the synergistic compatibility of parts, while lowering the cost and maintenance of such a kit,
- a system that will withstand the wind and snow loads as well as other harsh environment conditions,
- a system that is approved for residential use by governing authorities and that is not expensive to obtain such approval,
- a system wherein support stiffeners have means incorporated to receive a connector device and engage other components with an easily securable fit, while providing a weather resistant structural end product,
- a sag-resistant support member that spans well from post-to-post, beam-to-beam, or ledger-to-beam,
- a clip which can attach to support members and allow a flange to engage other supports or building covering materials,
- a clip which will easily maintain a uniform building layout and has the ability to engage itself end to end,
- a coupler in which a plurality of pergola kits can be connected together easily in order to expand the length and coverage a kit would not otherwise have,
- a shroud in which the expansion of pergola kits is made possible and in so doing maintains the structural integrity at a splice joint intersection,
- a horizontal strip that can engage a boss or flanges in a plurality of configurations,
- an improved pergola system that will conform to the rigid wind load capability of building codes, especially in hurricane zones such as in the state of Florida,
- and an improved pergola system that can accommodate additions of like construction to its width for an indefinitely extending system that meets building code requirements.

Still further objects and advantages will become apparent from a consideration of the ensuing description and drawings.

SUMMARY

In accordance with one or more aspects I provide a new plastic and rigid pergola which is easy to assemble. The pergola has connecting components which allow a simple fast and economical assembly of a kit system unique to the industry. The system enables parts to be used with conventional wood, metal, or composite materials for an alternative hybrid pergola system that is retrofitted to existing building structures or can be a free-standing unattached structure. According to one aspect, the pergola is formed from building members comprising a plurality of horizontal beams and vertical posts disposed at opposite portions of the beam. Means are provided for interconnecting the beams and posts. Generally horizontally disposed joists interconnect the beam means and horizontally disposed horizontal strips. The beams and the joists include a support stiffener positioned inside the beams and the joists.

DRAWING FIGURES

Figure 6B:
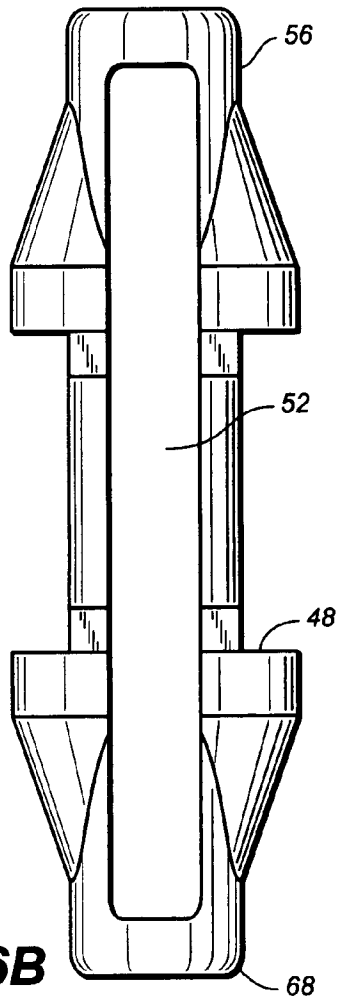
Figure 6A:
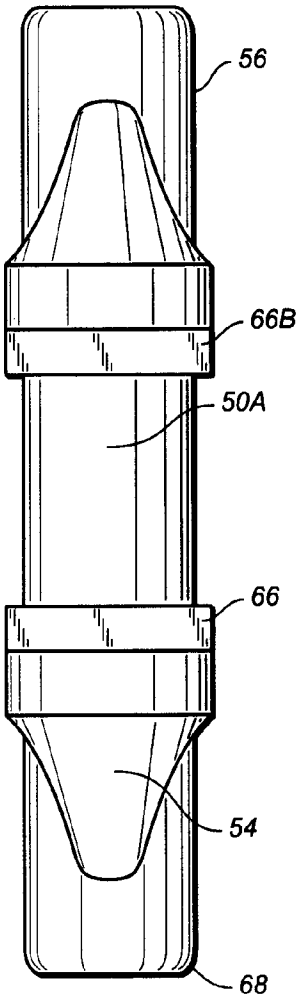
Figure 6:
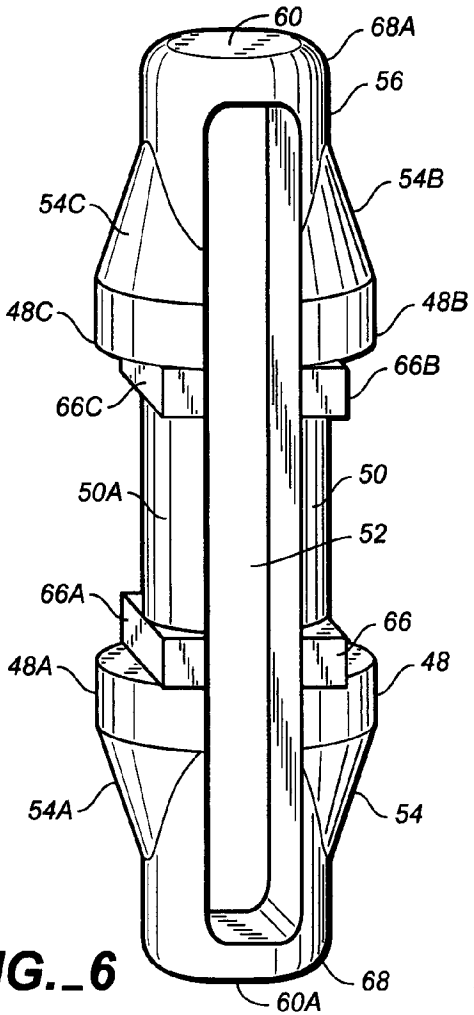
Figure 7:
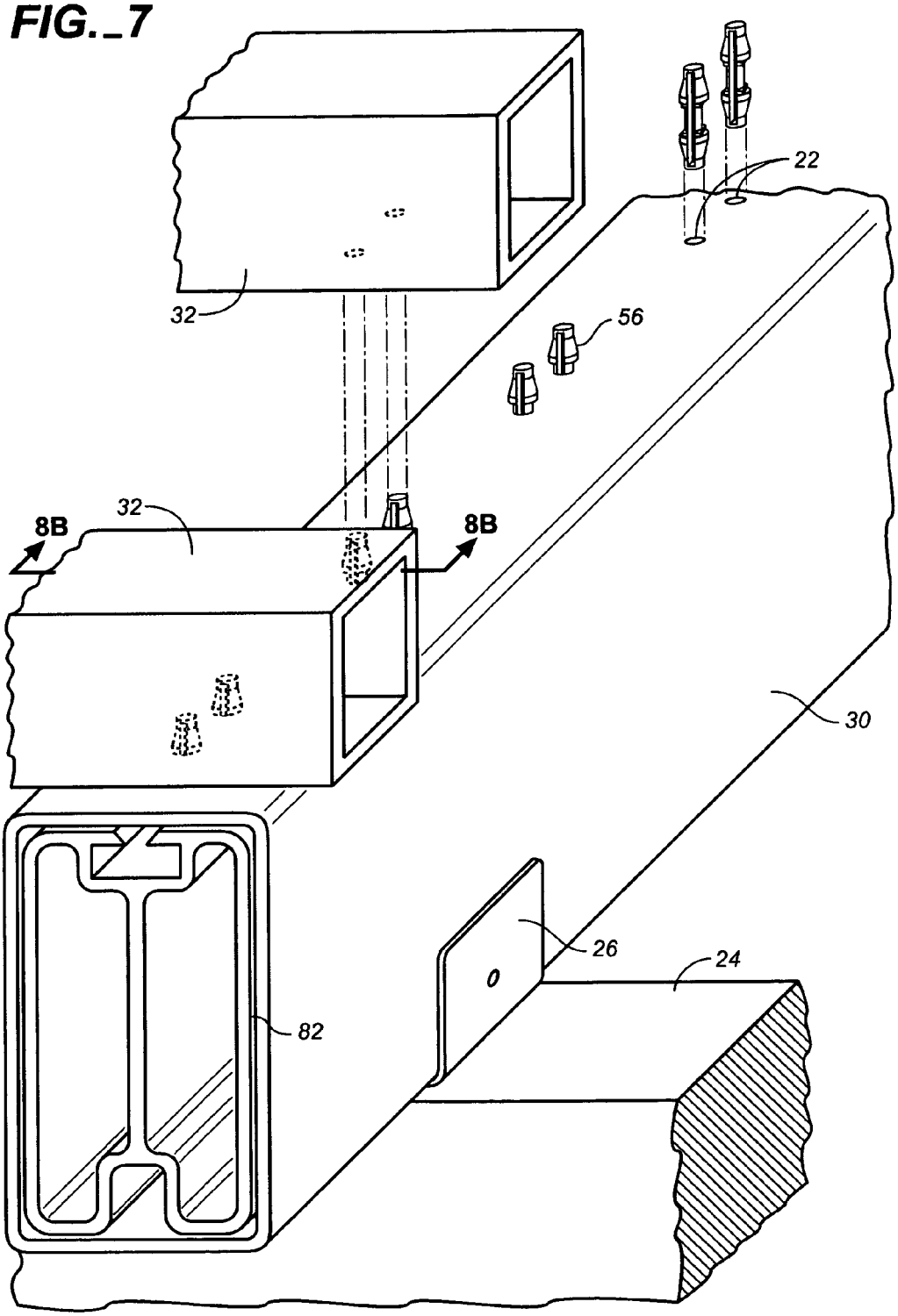

FIGS. 6, 6A, and 6B show perspective views of a preferred embodiment of a tap-lock pin used in the system of FIG. 7.

Figure 1:
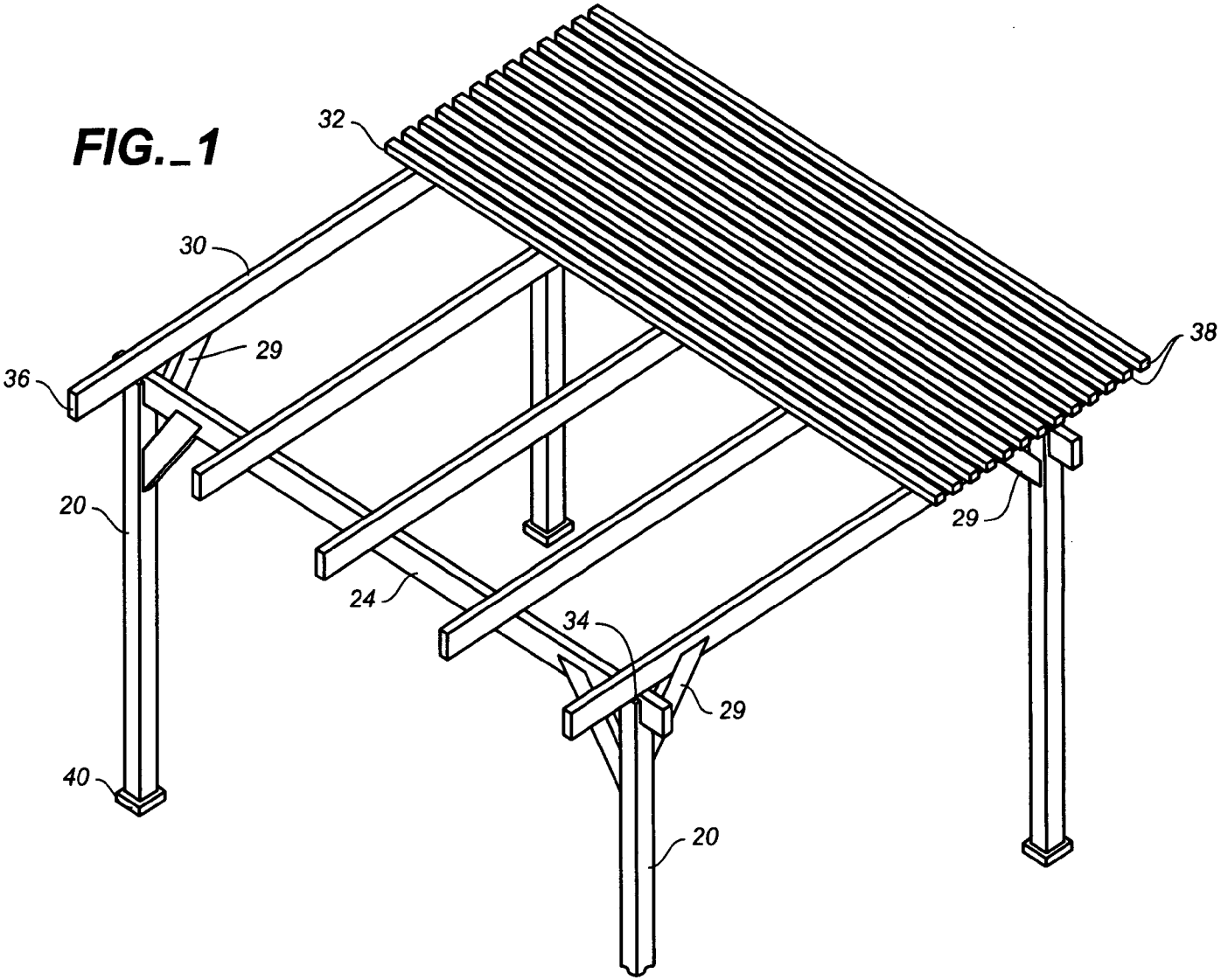
FIG. 1 shows a perspective view of a plurality of posts, beams, joists, horizontal strips and knee braces oriented to define a basic pergola system arrangement.

FIG. 7 shows a perspective view of a hollow horizontal strip with holes aligning with an upstanding portion of a base pin ready to engage with horizontal strip holes for the system of FIG. 1.

Figure 8A:
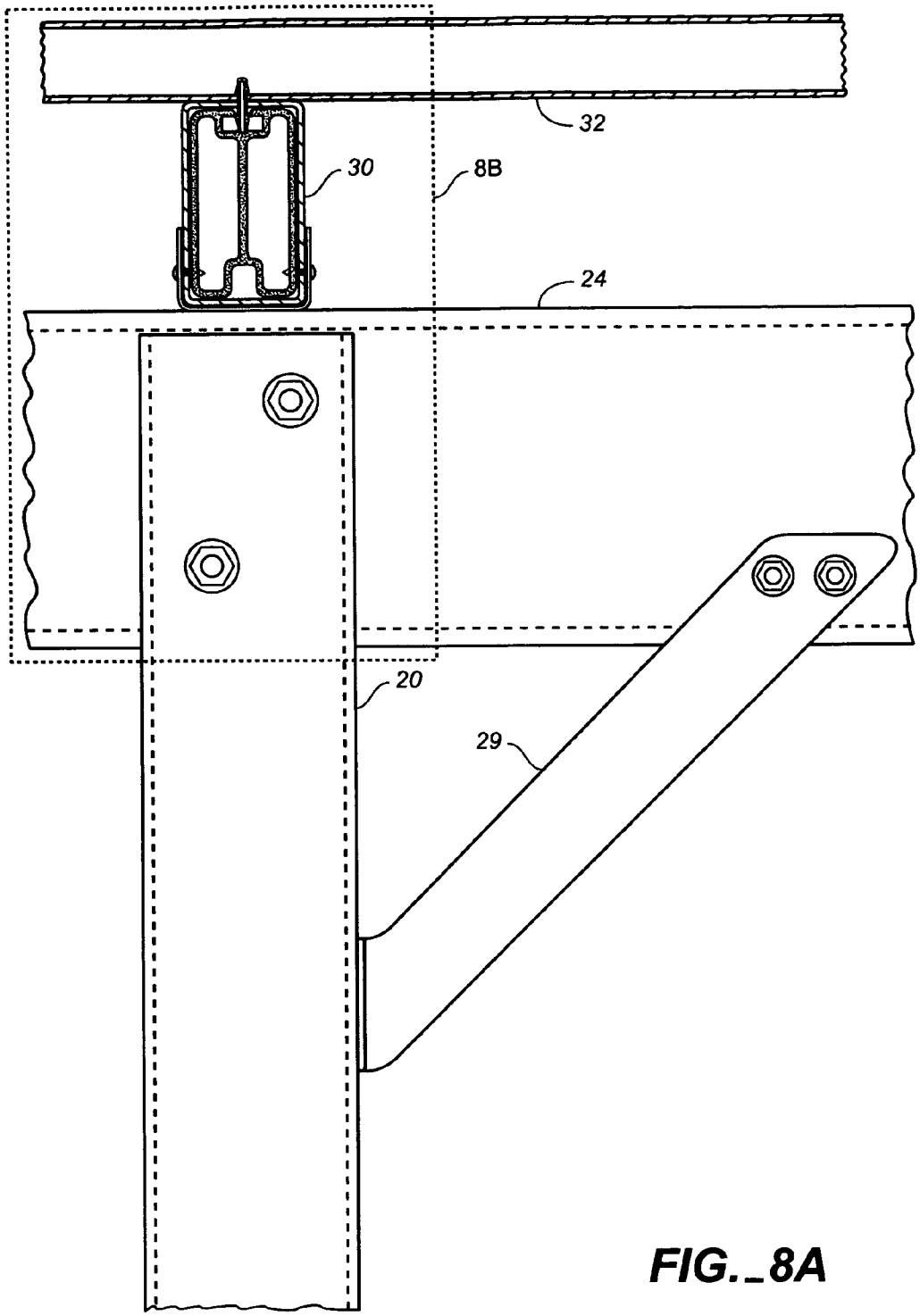

FIG. 8A shows a sectional view of a joist encapsulated with a vinyl rectangular extrusion connected to a horizontal strip with a tap-lock pin used in the system of FIG. 7 also including a post, beam and knee brace.

Figure 8B:
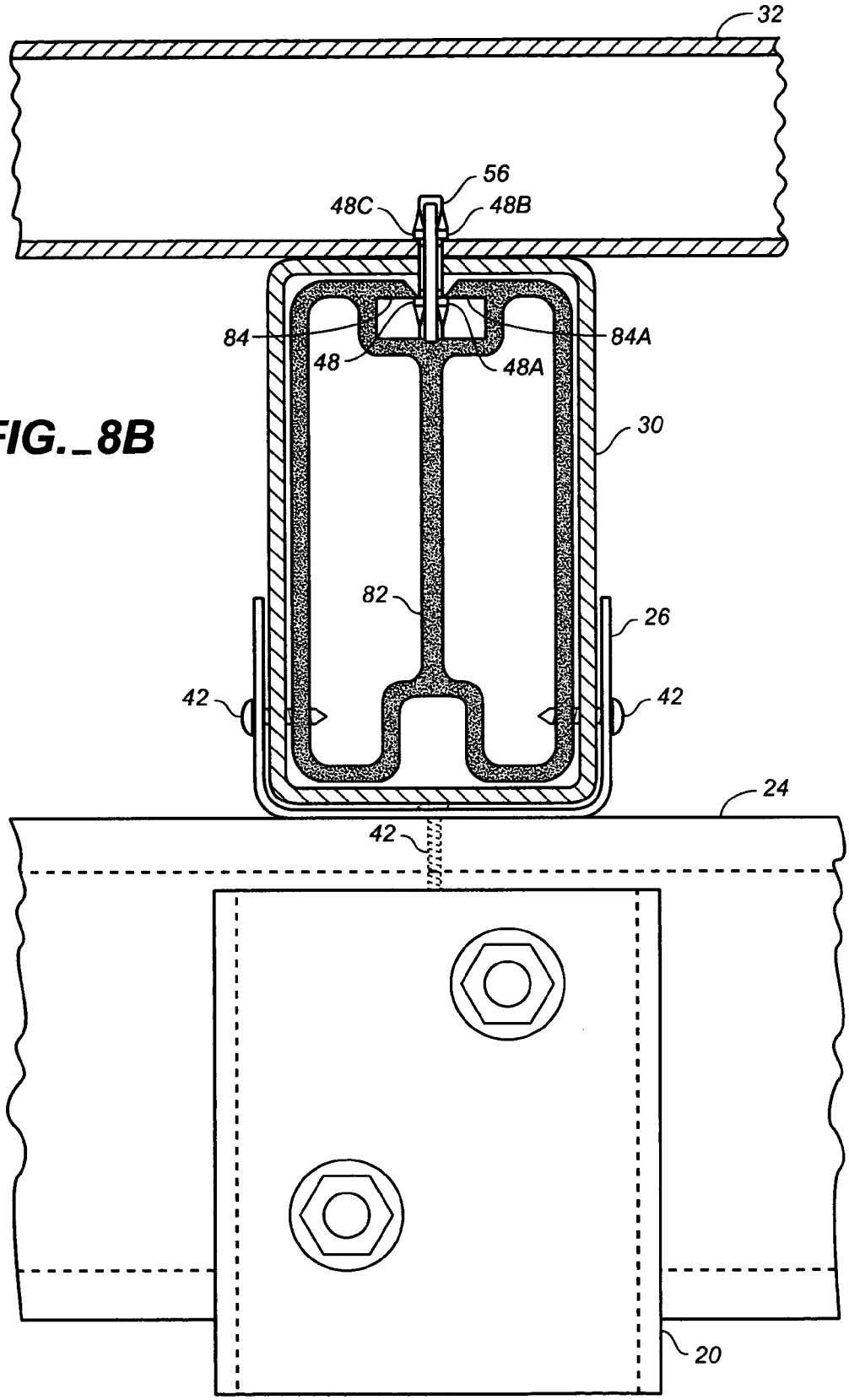

FIG. 8B shows an enlarged detailed portion of the system of FIG. 8A.

Figure 9:
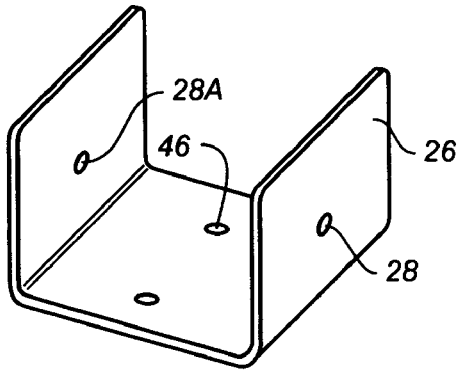

FIG. 9 shows a perspective view of a U-bracket and U-bracket-to-joist attachment hole used in the system of FIGS. 8A and 8B.

Figure 10:
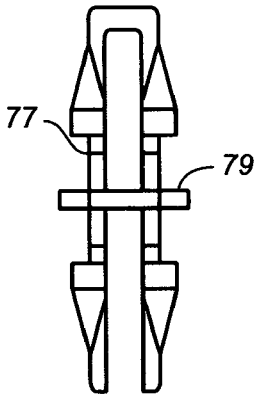

FIG. 10 shows an alternative embodiment of the tap-lock pin with a stand-off center portion.

Figure 11:
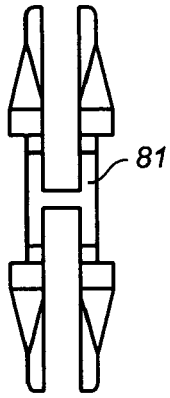

FIG. 11 shows an alternative embodiment of the tap-lock pin that can be used to replace the tap-lock pin in FIG. 7.

Figure 12:
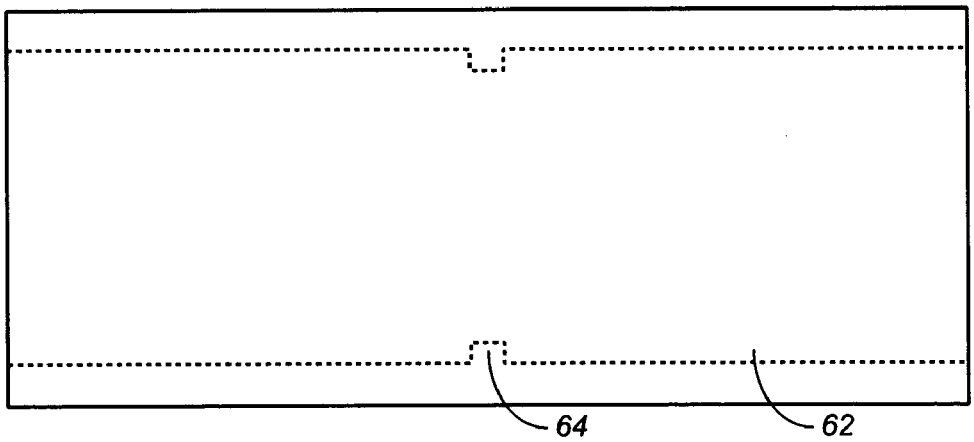

FIG. 12 shows a side view of a coupler for connecting horizontal strip ends together for mating a second pergola kit to the first.

Figure 13:
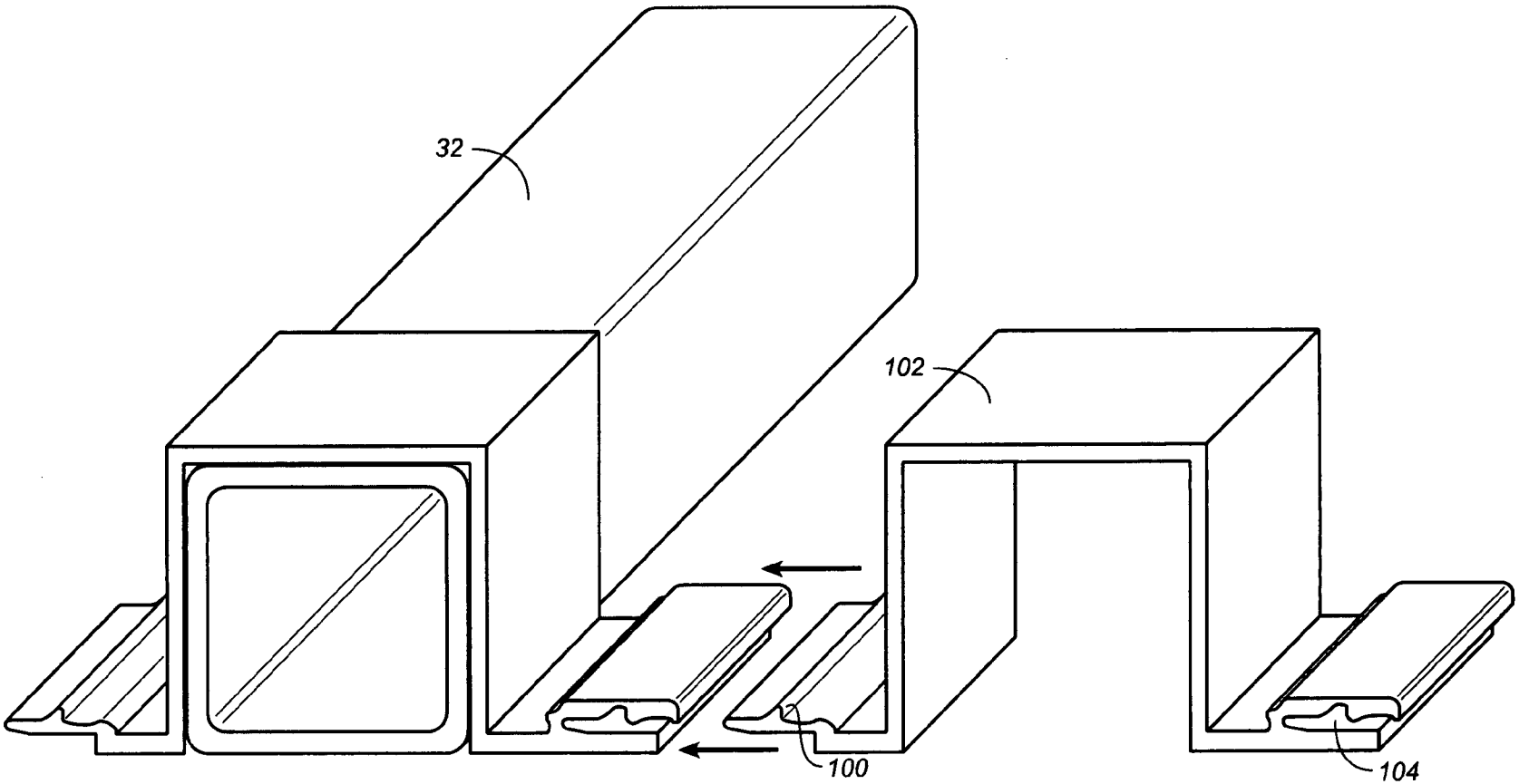

FIG. 13 shows a perspective view of a plurality of shroud joint concealment extrusions (as used in FIG. 1A) preparing to interengage one another as used when combining two pergola kits together.

Figures 14, 14A:
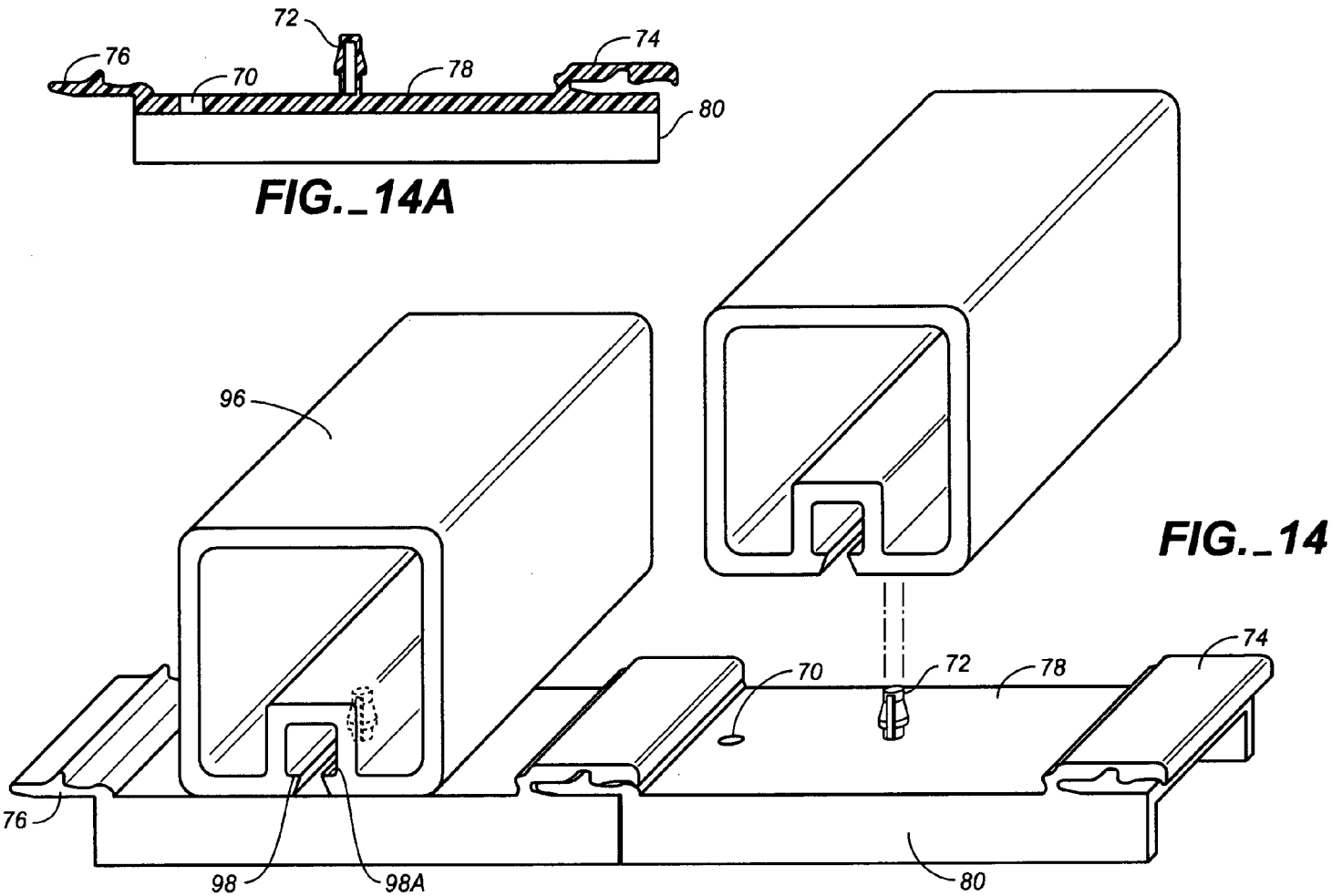

FIG. 14 shows a perspective view of a plurality of horizontal strips with recesses that extend down the length and contain ledges for a clip flange engagement connection to a clip tap-lock for an easily installable system.

FIG. 14A shows a side view of a single clip of FIG. 14 without the horizontal strips.

Figure 15:
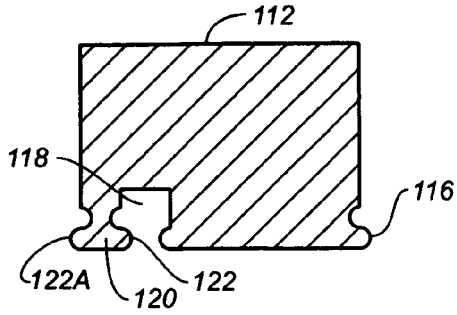

FIG. 15 shows a side view of an alternative embodiment of a horizontal strip for an alternative to the horizontal strip in FIG. 14.

Figure 16A:
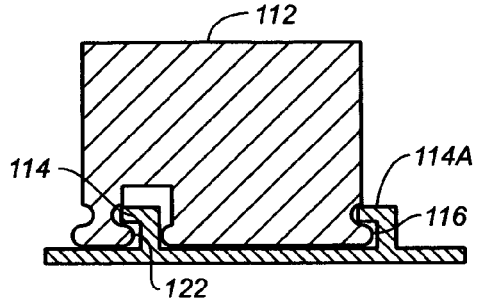

FIG. 16A shows a side view of an alternative embodiment of a horizontal strip with directional facing flanges for an alternative to horizontal strip of FIG. 14.

Figure 16B:
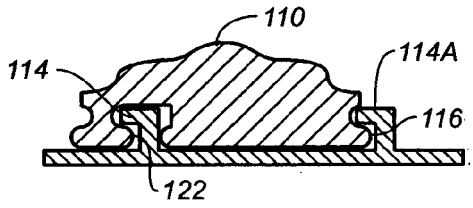

FIG. 16B shows a side view of an alternative embodiment of a horizontal strip that is not rectangular in shape with directional facing flanges for an alternative to the horizontal strip of FIG. 14.

Figure 17A:
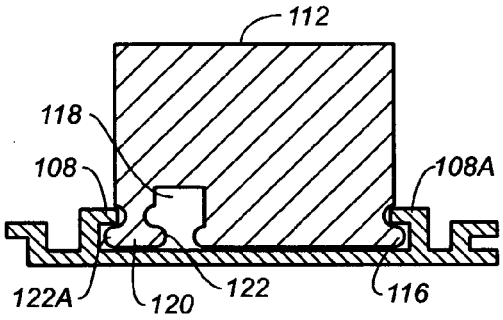

FIG. 17A shows a side view of an alternative embodiment of the horizontal strip with inwardly facing flanges for an alternative to the horizontal strip of FIG. 14.

Figure 17B:
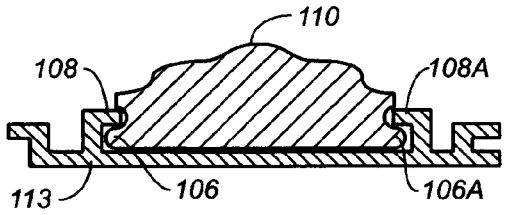

FIG. 17B shows a side view of an alternative embodiment of the horizontal strip with inwardly facing flanges for an alternative to the horizontal strip of FIG. 14.

Figure 18:
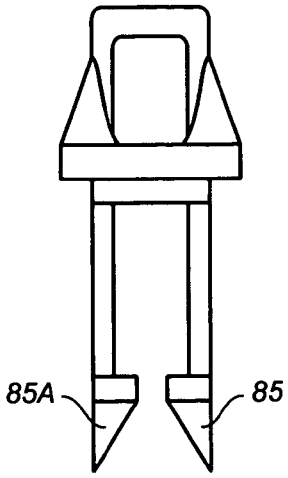

FIG. 18 shows a side view of an alternative embodiment of the tap-lock pin.

Figure 19:
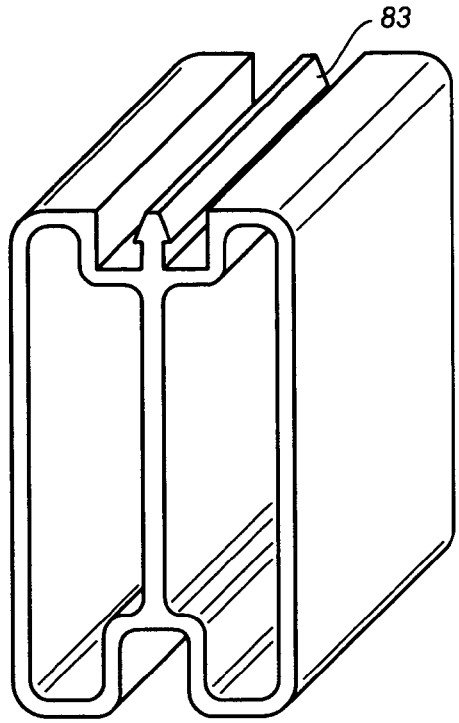

FIG. 19 shows a side view of an alternative embodiment of a structural support stiffener with flanges for connecting tap-lock pins.

Figure 20:
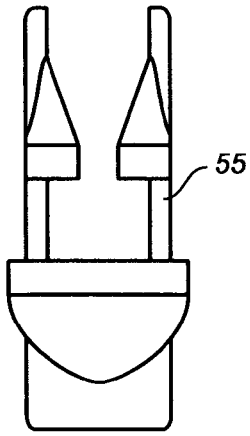

FIG. 20 shows a side view of an alternative tap-lock pin where the top half is rotated 90° from the lower half.

Figure 21:
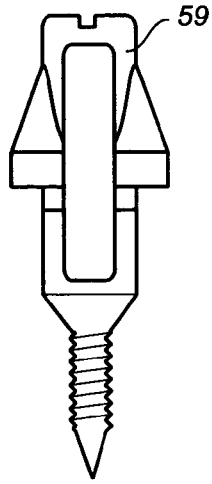

FIG. 21 shows a side view of an alternative embodiment of the screw-down tap-lock pin.

Figure 22:
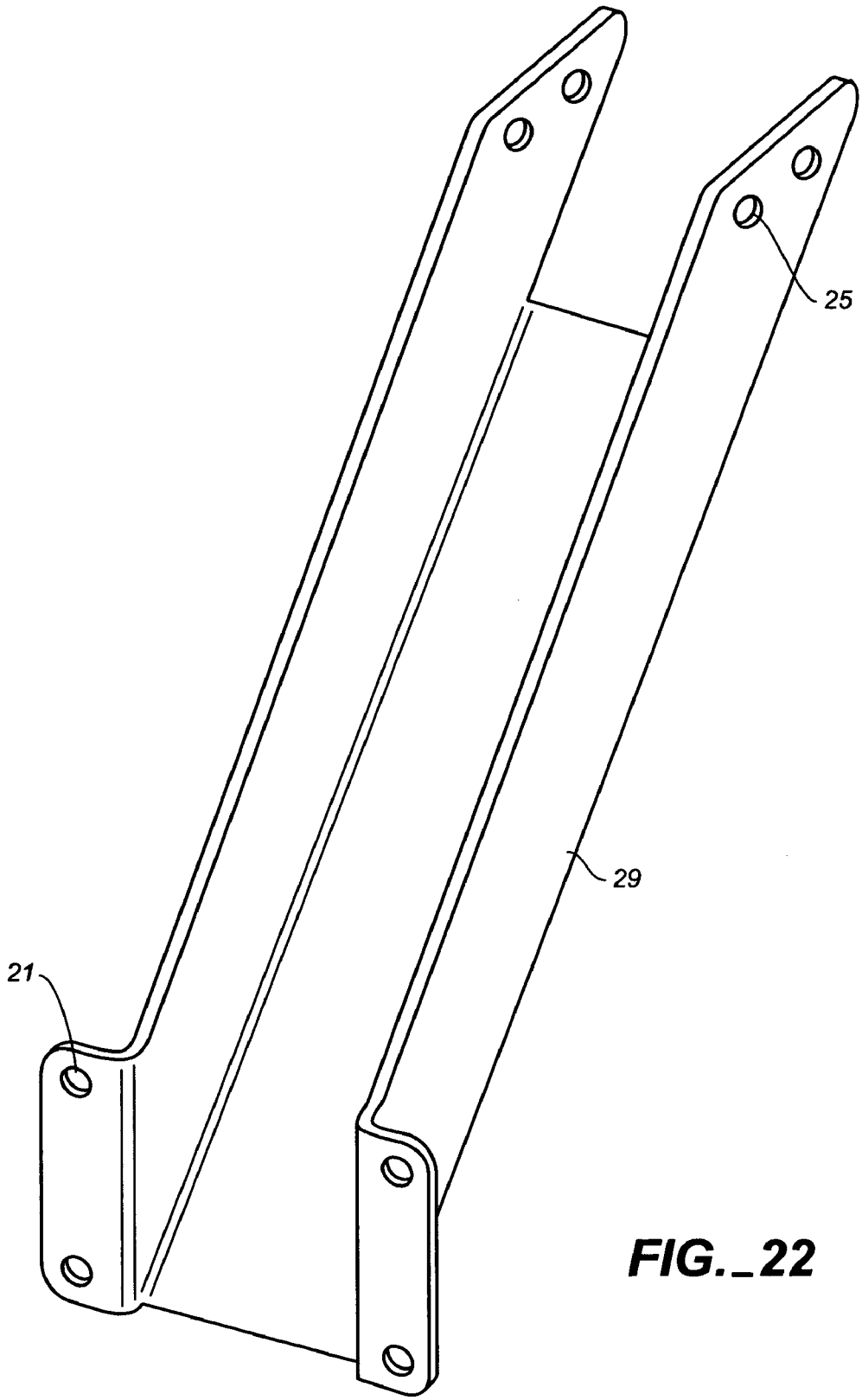

FIG. 22 shows a perspective view of a knee brace used on the system of FIG. 1.

Figure 23:
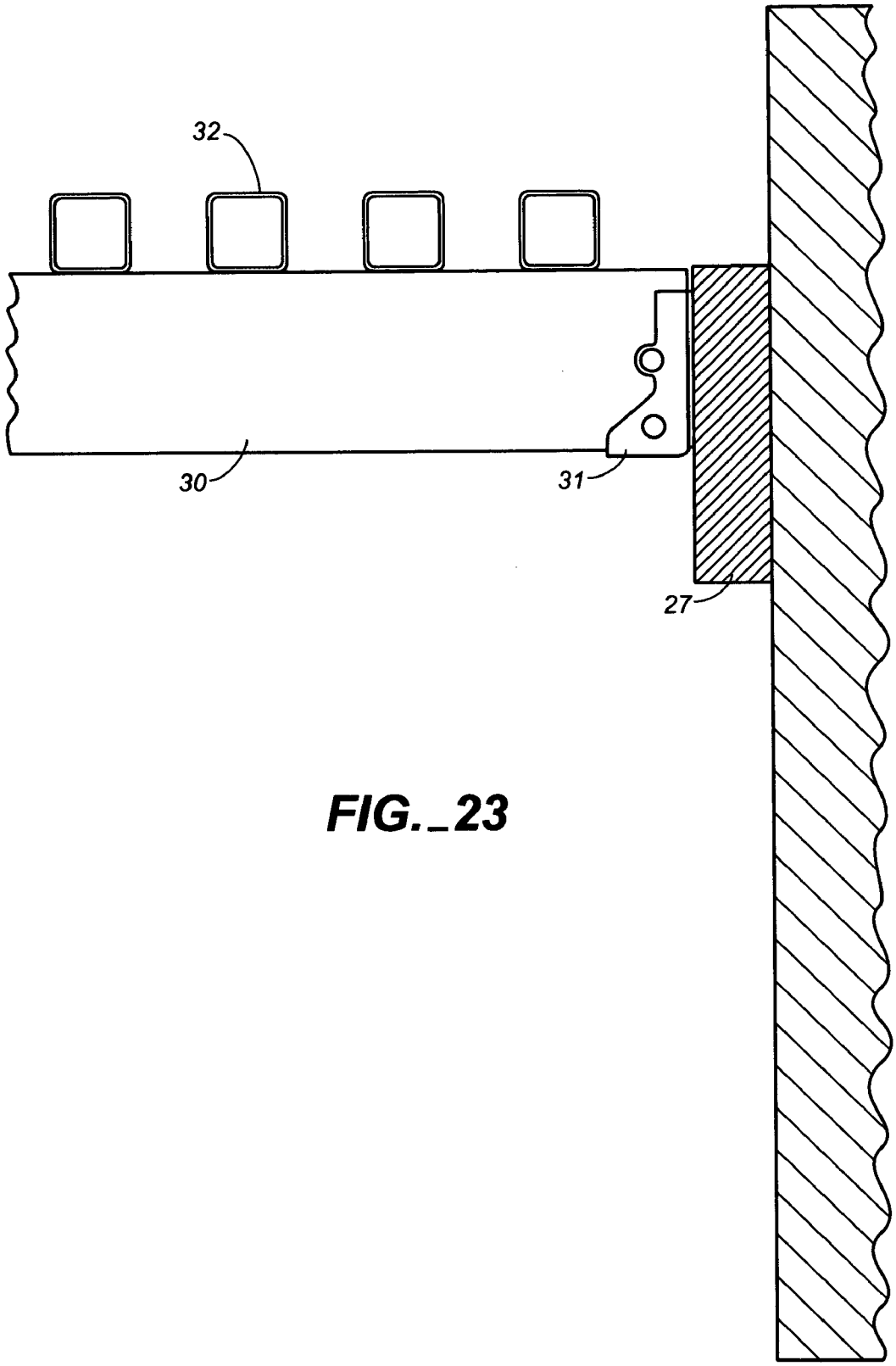

FIG. 23 shows a side view of a typical ledger-to-building connection for an attached pergola system.

Figure 24:
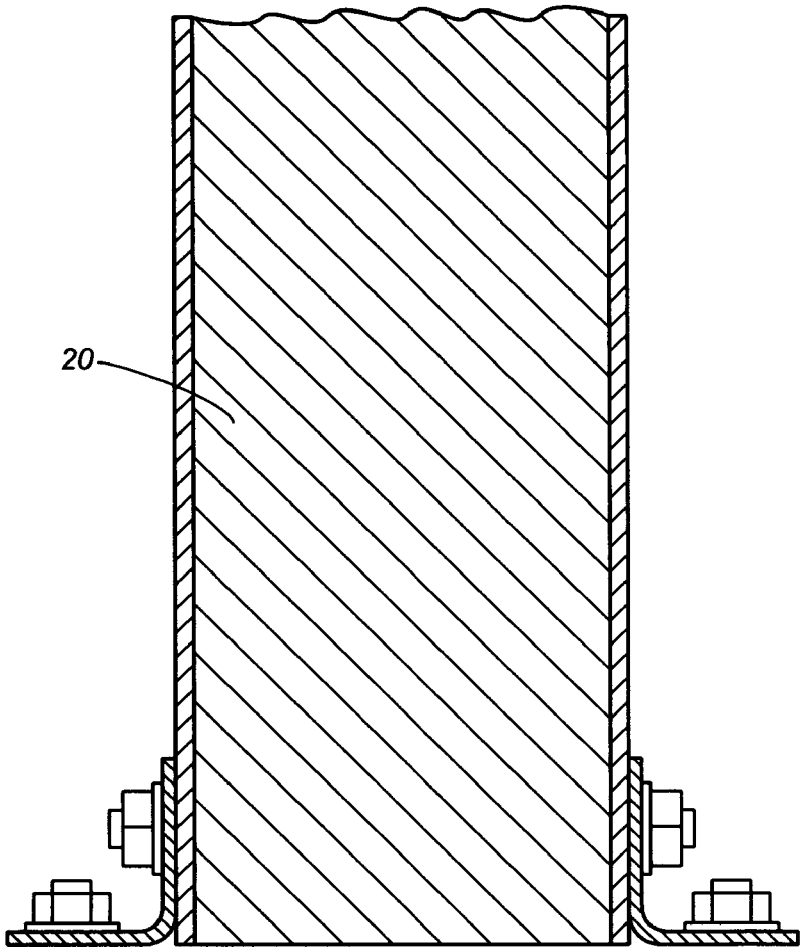

FIG. 24 shows a side view of a post mounted to the substructure of FIG. 1 with typical bolts and angles.

Figure 25:
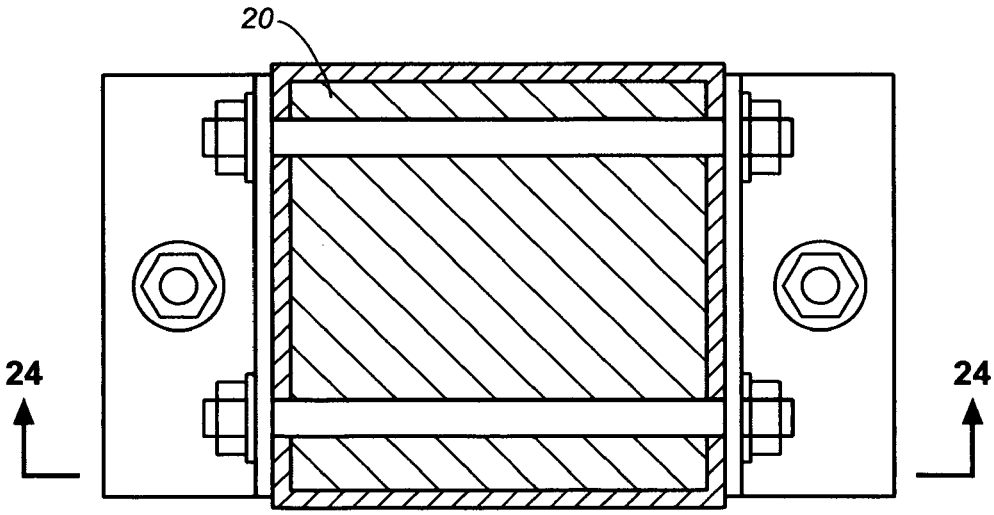

FIG. 25 shows a top view of a post mounted to the substructure of FIG. 1 with a typical bolt-and-angle bracket connection.

DRAWING REFERENCE NUMERALS

20 Post
21 knee brace post attachment holes
22 joist tap-lock holes
24 beam
25 knee brace joist attachment holes
26 U-brackets
27 ledger
28 and 28A U-bracket joist attachment holes
29 knee brace
30 joist
31 joist hanger
32 horizontal strip
34 post cap
36 end cap
38 horizontal strip cap
40 post base trim
42 self tapping screw
44 post-to-beam bolt connection
46 bracket-to-beam attachment holes
48, 48A, 48B, and 48C engagement ledges
50 and 50A elongated shaft
52 shaft void
54, 54A, 54B, and 54C compression ramp
55 alternative tap-lock pin with offset
56 tap-lock pin
57 alternative tap-lock pin
58 vinyl rectangular joist
59 screw down tap-lock pin
60 and 60A beam engagement end
62 coupler
64 center end stop
66, 66A, 66B, and 66C rotational stop
68 and 68A alignment cone

70 attachment hole
72 half-tap-lock pin connector
74 clip female engagement end
76 clip male engagement end
77 alternative tap-lock
78 base clip
79 center stand off
80 side edges
81 alternative tap-lock pin
82 reinforced beam
83 extruded joist with flanges
84 and 84A tap-lock engagement flanges
85 and 85A extruded tap-lock flanges
86 engagement zone
90 and 90A lower beam legs
92 bottom void
94 and 94A reinforced beam base
96 horizontal strip with ledges
98 and 98A ledges
100 shroud male end
102 shroud
104 shroud female end
106 and 106A ledge engagement zone
108 and 108A engagement flanges
110 horizontal strip
112 horizontal strip
113 clip
114 and 114A flanges
116 fixed portion
118 elongated recess
120 flexible leg
122 and 122A flanges

DETAILED DESCRIPTION

FIG. 1

The basic system provides a pergola comprising a joist, a beam, posts, and horizontal strips which are joined together systematically and with little effort using basic common tools found in most households. It can stand alone or it can be an outdoor extension of the house. Knee braces connect the beam-to-post and post-to-joist in order to stiffen the system for horizontal stability.

A preferred embodiment of a basic version of my pergola system is illustrated in FIG. 1 (perspective view). Four posts 20 are mounted or sleeved over wood posts or post mounts (not shown but known). The system has beams 24, joists 30, and posts 20, which are preferably made of hollow vinyl and house either a reinforcing beam 82 (FIG. 7) or a post mount (not shown), respectively. The top is covered by horizontal strips or laths 32 that are also hollow but do not have any reinforcement because they are not structural support members. The post mounts (not shown) can be made of steel or aluminum and can be notched at the top to receive beams 24. The post mounts are rectangular and sized to fit into posts 20. Posts 20 preferably are made of vinyl and clad the rectangular post mounts. Posts 20 are secured to the ground or base material by standard mounts as shown in FIGS. 24 and 25. Standard wedge bolts (not completely shown, but known) can be fastened to existing concrete slabs, for instance, through an L-angle with a hole to receive the wedge bolt for hold-down purposes. Two L-angles on opposite sides of posts 20 at the base will be anchored with wedge bolts and receive bolts through predetermined holes in the L-angles which connect and stabilize the post at the base portion of each post. Posts 20 will be notched or cut out with a router at or near the top (FIG. 8B) to receive beam 24 much like the post mount. Thus both the post mounts and covering posts 20 will be notched at their tops to receive beam 24.

Beam 24 preferably is made of vinyl, and supports joists 30. Each joist 30 comprises an elongated, preferably hollow rectangular joist sleeve 58 (FIG. 5) which houses a reinforcing beam 82 (FIGS. 7, 8A, and 8B). Beam 82 creates a structural relationship within the beam components that lends itself to long spans with minimal sag to the beam. The preferably rectangular extrusion that encapsulates the reinforced beam may have other than rectangular shapes so long as the inside portion of the extrusion is made to house the reinforcing beam.

FIGS. 2, 3, 4, and 5

Figure 2:
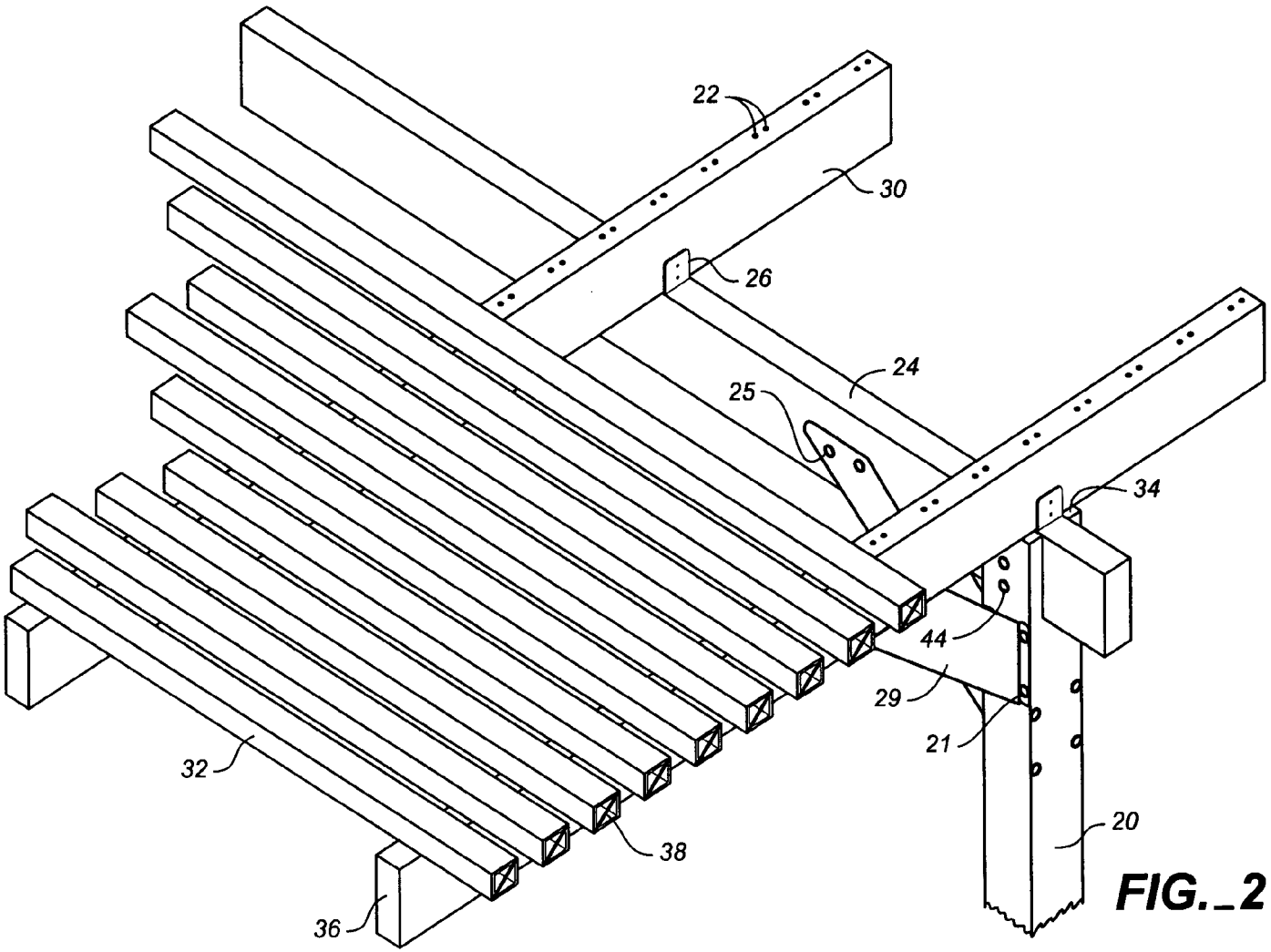
FIG. 2 shows a detail view of the post, beam, joists, horizontal strips, knee braces and other connection components of FIG. 1.

FIG. 2 shows post-to-beam bolt connection 44 found near the center of the notched or routed intersection of post 20 and beam 24 of FIG. 1. A U-bracket 26 has two U-bracket joist attachment holes 28 and 28A (FIG. 9). U-bracket 26 receives a self tapping screw 42 (FIGS. 8A and 8B) on both sides. U-bracket 26 attaches to beam 24 (FIGS. 8A and 8B) at bracket-to-beam attachment holes 46 (FIG. 9) using two self tapping screws 42 (FIGS. 8A and 8B) which connect U-bracket 26 to beam 24 at bases 94 and 94A.

Joist 30 (FIGS. 1, 1A, and 2) has reinforcing beams 82 (FIGS. 3 and 4) inserted into the joist. A vinyl rectangular joist shell 58 (FIG. 5) is placed into newly attached U-bracket 26 and secured with self tapping screws 42 through U-bracket joist attachment holes 28 and 28A (FIGS. 8B and 9). A tap-lock pin 56 (FIG. 6) attaches horizontal strip 32 to joist 30 in FIG. 7.

A knee brace 29 (FIGS. 1, 1A, 2, and 22) connects post 20 to beam 24 and post 20 to joist 30 to stabilize the upper portion of each post 20 from horizontal movement. High wind is the most prevalent cause for this type of movement. When a free-standing four-post system is being installed, eight knee braces 29 are needed to properly stabilize the system. Two knee braces 29 at each post connect post 20 to beam 24 and post 20 to joist 30. Current building codes require that the structure withstand up to 150 mph winds. When a structure is attached to another stable structure such as a house (FIG. 23) only two knee braces 29 are needed for the system to withstand high winds. Knee braces 29 are placed at post-to-beam connections and the attachment to the house result in the reduction of a number of knee braces so as to reduce the cost of a pergola kit. Standard fasteners (bolts and washers FIG. 8A) are needed to attach knee braces 29 to the post-to-beam or joist connection. FIG. 22 shows the angles and holes of the knee brace where bolts connect the knee braces to post and joist or to the post and beam. Alternatives to the knee brace are known which will provide similar results.

FIG. 1A

Figure 1A:
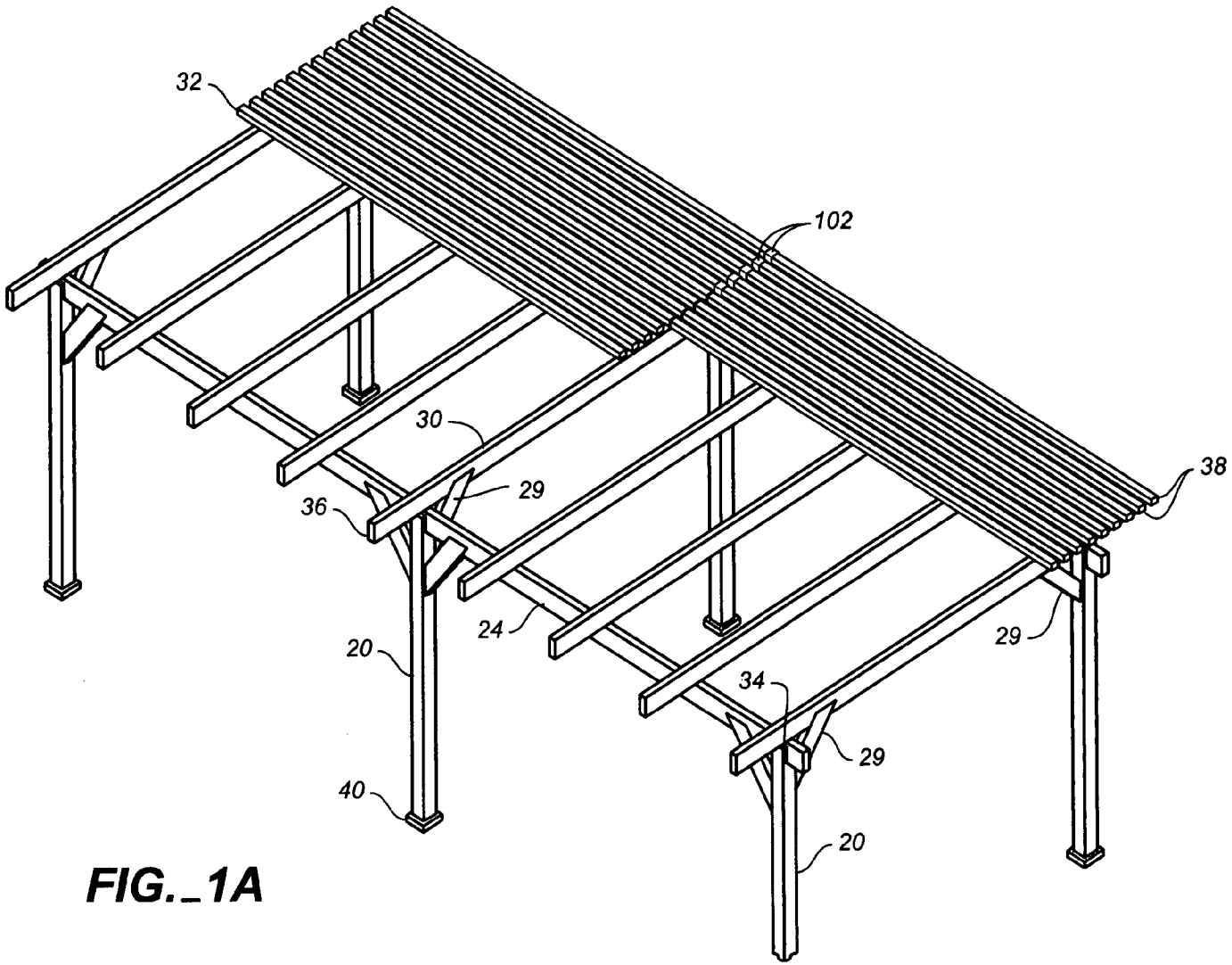
FIG. 1A shows a perspective view of an indefinitely extending pergola system using the system of FIG. 1.

The pergola of FIG. 1 can be extended width-wise (theoretically indefinitely) and is developed by adding to the width of the pergola, thereby to form a "perpetual" pergola (FIG. 1A). Two added posts 20 installed in line with the existing four posts 20 of a previously installed pergola are installed as previously discussed. Two beams 24 are placed into posts 20 to extend the width of the pergola by the appropriate length of beam 24. Two knee braces 29 are installed at each post 20 for stability. Extensions of the pergola can go on indefinitely when two knee braces 29 are attached to post-to-beam or post-to-joist connections. This combination of parts meets or exceeds the 150 mph requirements for high winds for this freestanding structure. The same is true for an attached system where one knee brace 29 is attached to each post 20. A ledger 27 on the existing building structure (FIG. 23) also extends in combination with post 20 and beam 24 (FIG. 1A). The extension of the ledger attached to the building, with joist hangers 31 connecting joist 30 to the ledger, provides stability to the pergola system.

When adding additional posts 20 and beams 24 in line with the existing two posts 20 of an attached system (FIG. 23), additional knee braces 29 are needed to provide stability on the projected portion of the pergola system. One knee brace 29 connects the post to the beam of the added post 20, and a second knee brace 29 is added to existing post 20 on the side where the added beam intersects with the existing post. The post that is now centered between the other two posts 20 has now two knee braces on opposite sides and outside posts 20 have one knee braces each of an attached pergola. Lateral movement is limited by the addition of the knee brace. Knee braces at the joist-to-post connection of an attached system may not be necessary due to the direct attachment of joists 30 to building ledger 27 (FIG. 23). To the best of my knowledge no other system is available that can be perpetually extended, yet withstand the highest wind conditions.

FIG. 1B

Figure 1B:
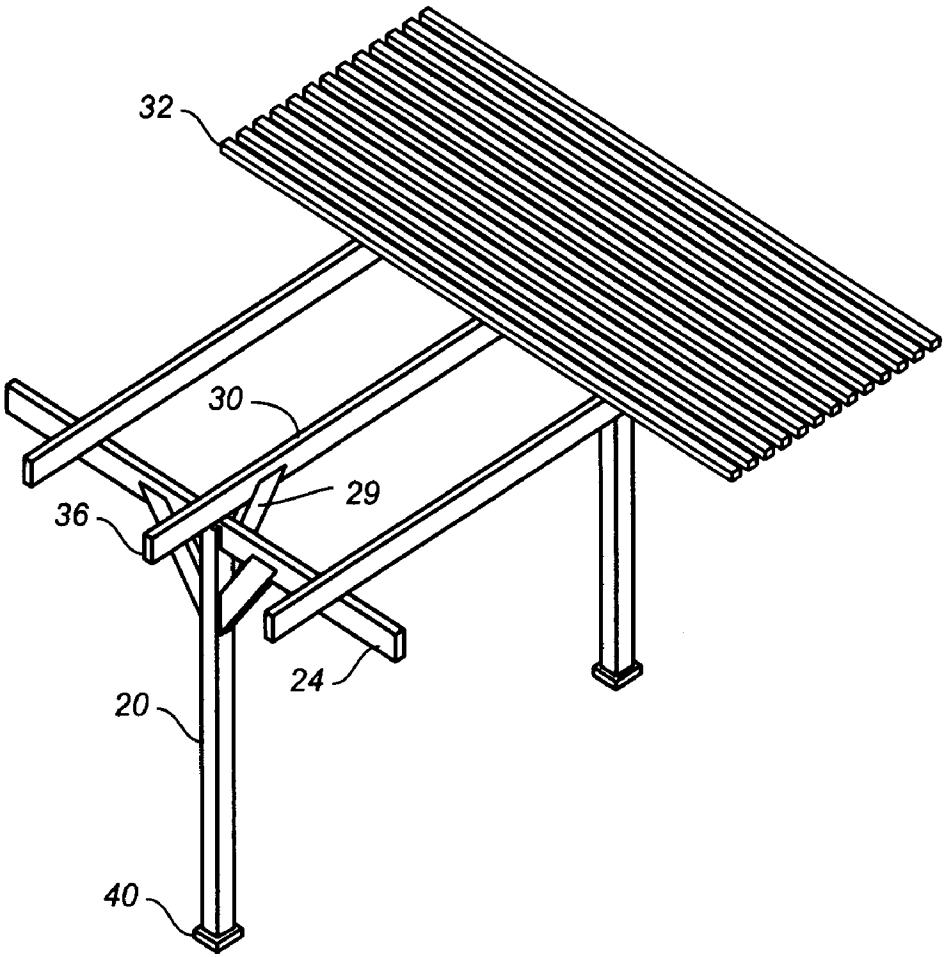
FIG. 1B shows a perspective view of a plurality of posts, beams, joists, horizontal strips and knee braces oriented to define a basic two-post pergola system arrangement.

A two-post pergola (FIG. 1B) with two or three joists 30 are secured on top of beams 24 to form a "T" like configuration. Each post 20 has two knee braces 29 which stabilize the beam-to-post connection. A third knee brace 29 connecting the joist to the beam is shown but may not be necessary for such a reduced size pergola. The posts of the pergola can be sleeved over a standard pressure treated 4"×4" wood post. Each post is placed in a hole and filled with concrete. The concrete stabilizes the post sufficiently for a small pergola to function properly. Post 20 is slid over or onto the wood post mount. Beam 24 is placed into a notch cut in post 20 (FIG. 8B). Two knee braces are installed to lock beam 24 to post 20. This forms a "T" configuration. Two such "T" configurations can support a plurality of joists 30 and horizontal strips 32 for a garden pergola.

FIG. 6

FIG. 6 shows a perspective view of tap-lock pin 56 and its physical structure. Pin 56 is preferably injection molded, which is economical and enables it to be made of a variety of plastics. Other processes can be used to manufacture the tap-lock such as casting, chemical molding, and mechanical stamping.

Alignment cones 68 and 68A taper to beam engagement ends 60 and 60A which are the flat ends of tap-lock pin 56.

Figure 4:
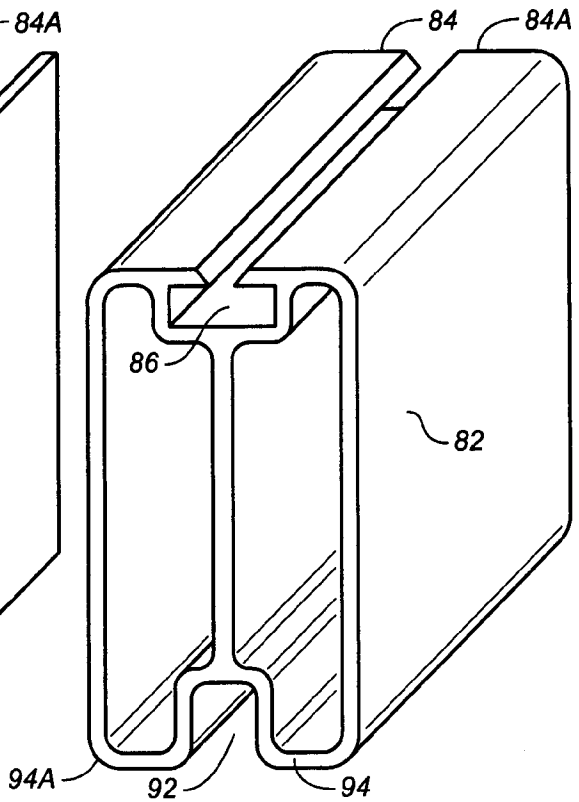
FIG. 4 shows a perspective view of a structural support stiffener.
Figure 3:
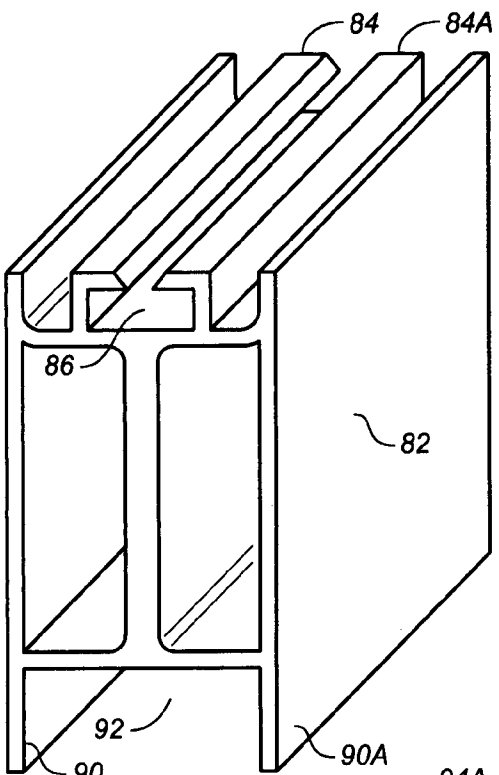
FIG. 3 shows a perspective view of an alternative embodiment of the structural support stiffener of FIG. 4.

Moving inward from each end of alignment cones 68 and 68A, conical compression ramps 54, 54A, 54B, 54C ramp outward from tap-lock pin 56 symmetrically on both sides and both ends. The ramps flatten out until they reach engagement ledges 48, 48A, 48B, 48C, which are secured to mating surfaces, such as tap-lock engagement flanges 84 and 84A (FIGS. 3, 4, and 8B).

Rotational stops 66, 66A, 66B, 66C protrude from the lower end of elongated shaft bodies 50 and 50A at the base of engagement ledges 48, 48A, 48B, 48C. Stops 66, 66A, 66B, 66C are flattened areas on the convex-shaped elongated shaft bodies 50 and 50A. These flattened areas inhibit rotation of tap-lock pin 56, allowing the connection of tap-lock pin 56 and tap-lock engagement flanges 84 and 84A (FIG. 8B) to remain in place.

In other connecting situations stops 66, 66A, 66B, and 66C (FIG. 6) may not be necessary.

Tap-lock pin 56 is symmetrical in this embodiment. A hollow shaft void 52 exists between shaft body 50 and 50A and beam engagement ends 60 and 60A (FIG. 6).

FIG. 1 shows a post cap 34, end cap 36, and a horizontal strip cap 38 which can be attached after erection of the pergola. A post base trim 40 must be slid onto post 20 prior to the installation of post 20.

FIG. 7 shows a perspective view of a horizontal strip 32 with mating holes that align with tap-lock pins 56 on joist 30.

FIGS. 7, 8A, 8B, and 9

On the top of joist 30 (FIG. 7) are a plurality of pairs of joist tap-lock holes 22 which index the port of entry for receiving a tap-lock pins 56 which connect to tap-lock engagement flanges 84 and 84A (FIG. 8B). Engagement flanges 84 and 84A are sloped or beveled. This aids in the engagement process by widening the initial opening portion of flanges 84 and 84A. This widened area creates a funnel to help guide a pin, such as tap-lock pin 56. Taplock pin 56 bottoms out on reinforced beam 82 (FIG. 8B) at engagement zone 86 (FIGS. 3 and 4).

When reinforcing beam 82 is placed inside hollow joist 30 (FIGS. 7, 8A, and 8B) or hollow beam 24 (preferably made of vinyl material, although fiberglass, composite, metal, or other plastic materials can be used) it becomes reinforced, giving it great utility for a multitude of applications. The rectangular reinforced beam can be cold formed or extruded and powder coated for appearance, eliminating the need for vinyl cladding. Holes or channels can be present on the cold form or aluminum extrusion to receive a connecting fastener for a horizontal strip or a full coverage profile, providing a water-resistant, full-cover shade structure. Due to its rectangular configuration, the rectangular reinforced beam or joist has a greater resistance to upward forces produced by hurricanes than does an I-beam. Reinforced beam 24 connects to reinforced joist 30 using U-bracket 26. Self tapping screw 42 passes through U-bracket attachment holes 28 and 28A (FIG. 9) and secures U-bracket 26 to joist 30. Self tapping screws 42 pass through bracket-to-beam attachment holes to secure U-bracket 26 to beam 24. Upward forces acting on the system are the most significant obstacles to overcome for a compliant system. The present system resists 150 mph winds yet is affordable to the general public for self construction.

FIGS. 2 and 7 depict joist tap-lock holes 22 in a row of pairs which extend down the length of joist 30. The row of pairs can be a row of one or a plurality which extend down the length of joist 30.

FIGS. 10 and 11

FIGS. 10 and 11 show alternative embodiments of tap-lock pin 56 and will be discussed further under Operation.

FIG. 12

A coupler 62 (FIG. 12) is rectangular in shape and made to couple two horizontal strips 32 at the respective ends of coupler 62. A center end stop 64 is present in the center portion of coupler 62 and prevents horizontal strips 32 from touching one another when coupled. Coupler 62 can be injection molded and formed to mate with loose ends of horizontal strips 32 (FIGS. 1 and 2) or a horizontal strip with ledges 96 (FIG. 14). Coupler 62 (FIG. 12), when mated with horizontal strips, can expand the pergola to any length. A center end stop 64 is located at the center portion of coupler 62 to regulate the distance a horizontal strip can travel inside coupler 62.

Coupler 62 can also be made as an internal coupler (rather than external) as represented. An internal coupler is easier to manufacture, needs less material to produce, but if the horizontal strip ends that mate with the internal coupler are not cut at 90°, a gap results, which can be viewed as aesthetically unacceptable.

FIG. 13

A shroud 102 (FIG. 13) is installed at a common joist. One half of the width of the joist top portion is designated for the horizontal strip of the existing pergola. The other half of the joist top portion would receive the horizontal strips of an addition or an indefinitely extending pergola. The shroud is corrugated in shape to conceal horizontal strips 32 for an architectural look as well as a fastening means at the splice joint. A shroud male end 100 and a shroud female end 104 mate with one another and can be used to join a plurality of shroud piece 102 in a manner depicted with a shroud female end 104 interconnecting with male end 100. The ability to build out from a splice expands the capability of the pergola kit systems immensely. One pair or a plurality of horizontal strip end pairs can be built into shroud 102. FIG. 13 depicts a shroud that conceals one pair only.

FIGS. 14 and 14A

FIG. 14 is a perspective view of an interengaging base clip 78 which, as will be explained, is useful for attachment to joists 30 (FIG. 1) for holding horizontal strips 32 or 96 (FIG. 14). Clip 78 has a protruding half-pin tap-lock connector 72. FIG. 14A is a cross-sectional view of the clip of FIG. 14. A female engagement end 74 will mate with a male engagement end 76 of a preceding clip. Half-pin tap-lock connector 72 has a similar design as to that of tap-lock 56 (FIG. 6A), but only one half of one end of pin 56 is used to create a protruding half-tap-lock 72 (FIGS. 14 and 14A). These half-like portions attach at spaced intervals to base clip 78 and provide a plurality of tap-locks 72 to maintain an accurate spacing to receive a horizontal strips with ledges 96 spaced uniformly. One or a plurality of protruding tap-locks 72 for each base clip 78 are possible. Clip 78 can be extruded, injection molded, pultruded (pulled+extruded), cast, mechanically formed, or chemically formed, as well as made by other forming methods. Injection molded plastic is preferred due to its ability to provide a professional look, imprinting capability, cost, and accuracy. Also a plastic flange and leg can flex and move into an engageable connection with the horizontal strip as may be necessary.

Side edges 80 can be designed into elongated clip 78 to aid in the alignment of a plurality of clips on a given substrate. The clip can be mounted with a screw at attachment hole 70 vertically, horizontally, or upside down for many building applications, such as acoustical walls or ceilings, floor grating systems, or fencing, keeping always in mind the versatility of the connection method.

Horizontal strip 96 has an elongated recess containing ledges 98 and 98A to engage either a tap-lock pin 56 or protruding tap-lock 72 on clip 78. This ability to engage the entire length of horizontal strip 96 with ledges 98 and 98A is believed unique to pergolas.

FIG. 14A shows a side view of clip 78 with side edges 80 and without horizontal strips shown in FIG. 14.

FIG. 15

FIG. 15 shows an alternative embodiment of a horizontal strip with elongated recess 118 with means to engage the flanges of a suitable clip and is similar to the elongated recess of FIGS. 16A and 16B. The alternative embodiment (FIG. 15) has one elongated recess 118 and it has an elongated groove that forms a fixed portion 116. Next to elongated recess 118 is a flexible leg 120 that is shaped like an upside-down T. It can also be shaped like a reverse capital L for reasons explained under Operation to follow. Flanges 122 and 122A help make up the base of a flexible leg 120.

FIGS. 16A, 16B, 17A, and 17B

A plurality of alternative horizontal strips can be manufactured. FIG. 17B shows an end view of a horizontal strip 110 with exterior ledge engagement zones 106 and 106A that will mate with inward opposing flanges 108 and 108A of a clip 113. Horizontal strip 110 does not have an elongated recess for engagement.

Many shapes, such as shown in FIGS. 16A, 16B, 17A, and 17B, are possible when mating the clip and horizontal strip together. It is important that plastic or a flexible material be used for the legs and flanges of the clip so the leg and flanges can move towards engagement with mating portion of the horizontal strip. This is especially true when the shape of the horizontal strip is such that the horizontal strip will remain substantially rigid, allowing flexibility only on the part of the clips.

FIG. 16A shows an end view of a horizontal strip 112 with a recess that mates with flanges 114 and 114A that are fixed in the same direction. This horizontal strip configuration allows the recesses of the horizontal strip to move or spread and engage horizontal strip ledges 116 and 122 with flanges and legs of the clip. The clip has rigid flanges and legs. The depth of the recess is directly proportional to the flexibility of the horizontal strip for engagement purposes. The clip can be rigid if desired, or plastic if both, the clip and the horizontal strip should flex independently and engage one another.

The alternative embodiment of FIGS. 16A and 16B can have a horizontal strip with an elongated recess like horizontal strip 96 (FIG. 14) and can have a clip that can mate with that recess. These alternative embodiments can be used with a standard pergola system. They can also be used with a retrofit system of an existing wood structure.

Clip 78 can be placed on existing wood or most other substrates and secured. The horizontal strips need not have a modular layout in order to be snapped down to tap-lock 56 (FIG. 8B) or the tap-locks on clip 78 (FIG. 14) although a modular layout generally appeals more to consumers. No layout difficulty exists, which aids in ease of installation. This ability to weave or bend horizontal strips 96 and engage them into the clip simplifies complicated geometric patterns not seen in the building industry. Three-dimensional patterns and arrangements are now available to architects for design purposes. The joist or substrate does not have to be parallel, aligned, or even at the same elevation in order for engagement to occur. A special hole alignment for the horizontal strip is not necessary to accomplish a three-dimensional pattern.

FIGS. 18, 19, 20, and 21

FIGS. 18, 19, 20, and 21 are alternative embodiments and will be discussed under Operation.

FIG. 22

FIG. 22 is a perspective view of knee brace 29 as discussed earlier under FIGS. 1 and 2.

FIG. 23

FIG. 23 is a side view of a typical ledger-to-building connection as explained earlier in connection with FIGS. 1, 1A, and 2.

FIGS. 24 and 25

FIGS. 24 and 25 show a side view and a top view of a post mounted to the substructure with typical bolts and angles as earlier explained.

Operation—FIGS. 1, 2-21, 24, and 25

The tap-lock pin and pergola kit can be installed more easily and faster than present pergola systems, yet has similar strength and rigidity. One first erects four free-standing posts 20 (FIG. 1) in a secured position using prefabricated post mounts (not shown) that receive the hollow posts. Also a 9 cm×9 cm pressure treated post can be bolted to the existing surface or substrate and hollow posts 20 can be slid (with post base trim 40) over the treated posts. The post mount is preferably a 6061 T6 aluminum extrusion. The post mount can fasten to the substrate (FIGS. 24 and 25) with two L-angle brackets on opposite sides of the post mount. A wedge anchor is used to attach the L-angles to the substrate and bolts attach the two L-angle to the post mount. This aluminum post mount, when properly attached, can withstand 150 mph wind loads. A Douglas Fir wood post of similar size cannot withstand such wind loads when installed in a similar way.

Other means of attachment of post 20 are possible. A throat cut, notch cut, or cut out portion at the top of posts 20 is routed out to receive two beams 24, respectively. Two posts 20 hold one beam 24 each. The four intersections of posts 20 and beams 24 near the center of the notch cut location receive at least one all-thread rod after a hole is drilled through both sides of post 20 connecting beams 24 to posts 20. A nut is fastened to each end of the rod to secure the beam-to-post at the post-to-beam bolt connection 44 (FIG. 2). A trim acorn nut can finish the appearance if desired.

FIGS. 8B and 9

Both beams 24 are then laid out for the attachment of U-bracket 26. Two self tapping screws 42 (FIG. 8B) are used to attach the base portion of U-bracket 26 through bracket-to-beam attachment holes 46 (FIG. 9) which connect beam base 94 portion (FIG. 8B) to U-bracket 26. Other bracket shapes are possible, but this three-sided, preferably stainless steel bracket is simple and straightforward in its connecting means.

FIG. 2

FIG. 2 shows a plurality of joists 30 which are located and attached at previously located U-bracket 26 with two self tapping screws 42 (FIG. 8B). Generally the joist members are parallel and spaced at a given distance from one another. However, with the uniqueness of the design and function of the pergola (FIG. 14) it is not necessary for the joist to have a given spacing or alignment in order for the connection of parts to occur. Beam 82 (FIG. 8B) reinforces the hollow profile joist and beams and increased the span capability of the joist and beams considerably. Rectangular reinforced beam 24 or joist 30 has great span and uplift resistance properties and can resist high wind uplift forces applied to the joist or beam.

Lower beam legs 90 and 90A (FIG. 3) increase the strength of the common beam configuration while providing attachment points for a structurally sound system that will endure in harsh weather conditions like hurricanes.

FIGS. 8A and 8B

Figure 5:
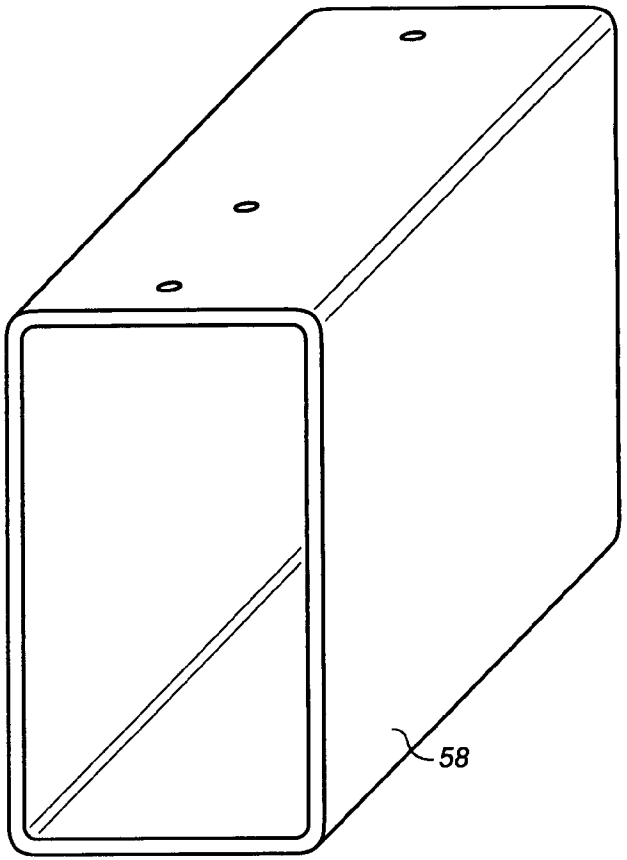
FIG. 5 shows a perspective view of a vinyl rectangular extrusion without a structural support stiffener.

FIGS. 8A and 8B show the positive connection of U-bracket 26 to both joist 30 and beam 24 with self tapping screw 42 at U-bracket joist attachment holes 28. Beam base 94 provides the attachment point on beam 24 for the securement of bracket 26 via bracket-to-beam attachment hole 46 (FIG. 9) using a self tapping screw 42. The structure of FIG. 4 differs from that of FIG. 3 slightly at the base portion. In FIG. 4 reinforced beam bases 94 and 94A create more contact area on the resting point where they are placed. This reinforced beam base also increases the wind resistance of the joist or beam due to the beam's hollow portion. In FIG. 3 lower beam legs 90 and 90A have narrow legs, which will touch the bottom portion of vinyl rectangular joist shell 58 (FIG. 5) when the stiffener of FIG. 3 is inserted into joist shell 58 (FIG. 5). The gap between the two narrow legs allow larger objects to be inserted into the void area 92 for appropriate applications. The narrow legs extend down from the upper hollow portion of the beam.

The profile of the beam stiffener of FIG. 3 is different from that of FIG. 4, which has a continuous hollow profile. FIG. 4 shows a bottom void 92 which has a narrow width which does not allow as large an object to be inserted into bottom void 92 of FIG. 3. When beam stiffener 82 is inserted into vinyl rectangular joist shell 58, stiffener 82 has been encapsulated or cladded. Bottom void 92 allows the insertion of building materials when vinyl rectangular joist shell 58 has cut or routed shapes at void 92 side of the encapsulating profile. Horizontal strips for a band rail can be placed in the cut shapes and inserted into void 92 of the reinforcing beam for a well-built structural handrail. Also, safety glass (not shown) can be inserted into void area 92 via a cut shape in vinyl rectangular joist shell 58 for a glass handrail application. A variety of building materials can be inserted and adapted for architectural purposes because of the function void 92 provides.

The standard system of FIG. 1 can easily be enhanced without undue constraints due to the simplicity of the basic kit.

FIG. 7

Elongated tap-lock engagement flanges 84 and 84A (FIG. 8B) house tap-lock pin 56. FIG. 7 shows joist tap-lock holes 22 which index the entry ports for tap-lock pin 56. Pin 56 is held over the hole and driven or tapped down with a hammer, for instance, with appropriate force. Pin 56 enters the joist tap-lock hole easily due to alignment cones 68 and 68A (FIG. 6) whose contour aids the insertion of pin ends 60 and 60A.

Conical shaped compression ramps 54, 54A, 54B, 54C compress or squeeze elongated shafts 50 and 50A together at shaft void 52 (FIGS. 6 and 6B) while traveling through both joist tap-lock hole 22 (FIG. 7) and tap-lock engagement flanges 84 and 84A (FIG. 8B). This allows engagement ledges 48 and 48A to interconnect with tap-lock engagement flanges 84 and 84A.

As beam engagement end 60 (FIG. 6) of tap-lock pin 56 bottoms out at engagement zone 86 (FIG. 4) rotational stops 66, 66A, 66B, and 66C (FIG. 6) restrain the tap-lock pin from rotating 90° when engaged and hold it in position. Tap-lock pin 56 has a stronger grip when inserted into the aluminum flanges than it would if it just connected plastic to plastic.

This operation is repeated at all the desired joist tap-lock holes 22 (FIG. 7) on joist 30.

FIGS. 7 and 8B

FIGS. 7 and 8B show a sectional view of a hollow horizontal strip aligned with the upstanding portion of tap-lock pin 56 protruding from joist 30. Horizontal strips 32 are predrilled so its holes will mate with the remaining portion of pin 56 that protrudes from joist 30. An installer need only pull down strip 32 with minimum force and the remaining end of pin 56 will again compress and interconnect pin 56 with horizontal strip 32.

Engagement ledges 48B and 48C (FIG. 8B) grab the wall of strip 32 as it is pulled down with minimum force. There is no need for tap-lock engagement flanges 84 and 84A since strip 32 provides a 360° area around the drilled hole is perimeter for engagement ledges 48B and 48C of pin 56 to interconnect with.

The procedure of aligning the horizontal strip holes with the protruding portions of pins 56 and pulling down is repeated until all the horizontal strips have been engaged. The parts may thus be connected very rapidly and in a simple yet secure manner.

FIGS. 10 and 11

An alternative embodiment of tap-lock pin 56 can be seen in FIGS. 10 and 11. Original tap-lock pin 56 can have its beam engagement end 60 (FIG. 6) split in half on one end to form an alternative tap-lock pin 77 (FIG. 10). Both ends 60 and 60A of tap-lock pin 56 can be split in half to form alternative embodiments 81 (FIG. 11). The one or two split end alternative tap-lock pins 77 and 81 (FIGS. 10 and 11) will squeeze together at the outer ends of the pair of flanges when inserted into a hole, for instance, and engage the component parts. Also split end tap-lock pins maybe offset by 90°, for instance, and engage both tap-lock engagement flanges 84 and 84A and the predrilled holes of horizontal strip 32. Center stand off 79 of the alternative embodiment (FIG. 10) can form a stop so that when inserted into a hollow object, the pin will not plunge into the cavity and be of no use. A similar center stand off as in FIG. 10 can be adapted to both tap-lock 56 or alternative tap-lock pin 81. The beam surface (FIGS. 3 and 4) at engagement zone 86 creates a bottoming out location so a stand-off stop is not needed. Many other embodiments can be manipulated in shape for equivalent results.

FIG. 14

A plurality of engagement clips 78 (FIG. 14) can be fastened to a surface with self tapping screws 42 or the like at attachment holes 70. Each clip preferably has a male end 76 and a female end 74 which interengage when the ends are pushed together.

Side edges 80 can be on one or both sides of clip 78 and will help alignment of the clips when attached to existing joists. Side edge 80 is not absolutely necessary for clip 78 but helps the average homeowner with ease of installation.

An existing wood joist of a pergola can be retrofitted with clip 78. The upstanding protruding tap-locks 72 can receive horizontal strips in a similar manner as previously mentioned with tap-lock pin 56 if the layout permits the holes to align with one another. If holes do not align, a horizontal strip with ledges 96 can be installed without difficulty due to ledges 98 and 98A which run down the length of strip 96. The horizontal strip can be pulled down and engaged with clip tap-lock 78 (FIGS. 14 and 14A) at protruding flanges 72 easily. Parallel or even alignment of joists is not required due to the flexibility of horizontal strips 96 to engage the entire length of the horizontal strip. Clip 78 can also be made with a groove to receive tap-lock pin 56. This allows some variation of the hole layout since tap-lock 56 can move horizontally back and forth the distance of the groove. Clip 78, if made with a groove, can be extruded or injection molded. The heights of the joist are also not critical in order for engagement of horizontal strip with ledges 96 of clip 78. A retrofit in most cases requires such a flexible application due to the multiple arrangements of old installed pergolas joists. The tap-lock pin can be made solid rather than hollow or split when using horizontal strip 96. The horizontal strip-ledges expand outwardly and engage the solid alternative tap-lock pin, allowing a simple snap-together assembly.

Alternative Embodiments of Clip Tap-Lock and Horizontal Strip

Multiple alternative embodiments of both clip 78 and the horizontal strip with ledges 96 are possible, and provide an equivalent system. For instance, clip 78 can have protruding tap-locks 72 reconfigured so a pair of outward facing flanges engages the ledges of the horizontal strip at ledges 98 and 98A. It only takes the splitting of the vertical axis of protruding tap-locks 72 (such as in FIG. 11) to create a pair of flanges that look like one half the pin of FIG. 11.

FIG. 17B

FIG. 17B is an end view of an alternative embodiment of a horizontal strip 110. It has a profile with grooves 106 and 106A that mate with inward opposing flanges 108 and 108A. This engagement is accomplished by inserting ledge engagement zone 106 of horizontal strip 110 into flange 108 and rotating the opposite ledge 106A in the direction towards remaining flange 108A and applying pressure so that horizontal strip 110 engages flanges 108 and 108A of clip 113.

The bottom portion of horizontal strip 110 can be rounded or curved to provide a novel shape. This curved portion will not hinder the connection just described and will add a different appearance to the underside of the standard rectangular horizontal strip.

Clips 113 can be made to engage end for end, butt end for end, or be spaced apart from one another. The interengagement of one another helps to simplify layout for the average homeowner.

FIG. 16A

FIG. 16A shows an end view of an alternative embodiment of a horizontal strip 112 with an elongated recess that will mate with a pair of flanges 114 and 114A at horizontal strip ledges 122 and 116. The flanges run in the same direction but can easily be configured towards one another (FIG. 17A) or away from one another. Alternative embodiments with a plurality of recesses with ledges of a horizontal strip can be extruded. These extruded profiles can also have protruding flanges that face one another, face away from one another, or face in the same direction as one another and still engage the parts. One skilled in the art can easily alter the extruded profile shown in FIG. 16B or alter clip tap-lock with ledges. This can produce profiles or clips with equivalent results with no real improvement of the system. The horizontal strip can have shapes on the sides of the profile that receive inwardly facing protruding flanges of the clip tap-lock for engagement. This alters the look from the underside of a plurality of horizontal strips only slightly.

FIG. 15

FIG. 15 shows a horizontal strip 112 with one elongated recess 118 that has an elongated flange 122 within the recess 118. A protrusion forming a fixed portion 116 resides on opposite side of flexible leg 120. This fixed portion 116 can be placed in an inwardly facing clip flange (FIG. 17A) upon installation. Elongated recess 118 is purposely shaped to provide a flexible leg 120 which is shown shaped like an upside-down T. The receiving flange of leg 120 (FIG. 16A) can face in the same direction as the flange of fixed portion 116 and engage when downward force is applied at flange 122. It is also possible for the flange which engages flexible leg 120 to face inwardly (FIG. 17A) from the outside of the profile for engagement using the outer portion of the upside down T flange 122A. Also just an L portion can exist at movable leg 120 and face either direction. The flexible leg 120 will mate with appropriate mating flanges in the proper connecting direction.

FIGS. 18 and 19

FIG. 18 shows a side view of alternative tap-lock pin 57 with inward facing flanges that can engage an extrusion like that of FIG. 19 at extruded tap-lock flanges 85 and 85A. Again many slight alterations can be made which give equivalent results.

FIG. 19 shows an extruded joist with flanges 83. The hollow portion of vinyl rectangular joist 58 can house the reinforced beam. The beam does not need to have flanges 84 and 84A for tap-lock engagement.

FIG. 20

FIG. 20 shows a side view of an alternative tap-lock pin with an off set 55 which can also attach to the extrusion of FIG. 19. The inward facing flanges are rotated 90° from the lower outward facing flanges and can be attached to appropriate mating surfaces.

FIG. 21

FIG. 21 shows a side view of an alternative embodiment of screw-down tap-lock pin 59 which can be made of a rigid material that can be fasten or screwed down to a surface like a regular screw. The top portion of the tap-lock pin can have a slotted recess to allow the screwing process to take place with a standard screw driver. When the attachment portion is complete the remaining portion of the pin can be configured to engage horizontal strips. Screw-down tap-lock pin 59 can be installed in existing wood joists. Horizontal strip with ledges 96 can engage with and secure the horizontal strips to the standup portion of the alternative tap-lock pin. The same basic interconnection of the horizontal strip and pin 59 occurs with the upstanding portion of screw-down tap-lock pin 59.

To expand a pergola kit easily, a coupler 62 (FIG. 12) can be coupled to the end of each horizontal strip of the pergola and pushed on until the horizontal strip touches center end stop 64 of coupler 62. Couplers 62 are placed on all the ends of the horizontal strips that are to be joined with a second or expansion pergola kit. The ends of the second pergola kit are placed into the remaining end of coupler 62 and inserted to center end stop 64. Horizontal strip cap 38 (FIG. 2) is not needed at the coupler joint in this application.

Pergola arrangements are unlimited when using coupler 62 (FIG. 12) for an expansion enhancer. Shroud 102 (FIG. 13) with interengagement ends 100 and 104 can conceal an end joint over a joist easily. The horizontal strip ends are aligned across from one another over a common joist, forming a seam or splice of horizontal strip ends. A plurality of shroud clips can be interengaged and will form a mating pattern that will cover the contour of the joist and horizontal strips. The shroud is attached with fasteners which attach the shroud to the common joist down the length of the joist. An appropriate quantity of fasteners are used to hold the shroud and horizontal strips firmly in place. The fasteners are located where the shroud contours with the joist surface, providing aesthetic appeal with securement. By attaching a shroud over a joist, the strength of the horizontal strips is not compromised for loading purposes, such as snow loads at unsupported seams. The horizontal strip from joist to joist remains monolithic, allowing a structural connection at the seam. Wind and snow loads may need this added advantage when pergola expansions in the form of multiple kit systems are combined. Shroud 102 will out-perform coupler 62 (FIG. 12) as a structural component, since the coupler is attached between joists, rather than bearing directly over a joist as with the shroud.

ADVANTAGES

From the description above, a number of advantages of my tap-lock pin and assembly system become evident:

(a) The combination of the tap-lock and predrilled horizontal strips allows quick and easy installation of pergola kits.

(b) The combination of the clip tap-lock and horizontal strip and ledges allows quick and easy retrofits of existing structures or structures that utilize only that combination of parts.

(c) The elongated shapes formed from an extrusion or the like provide multiple simple connection points. These points when mated with clip flanges interengage with proper means for a complete thought out easily installed kit system.

(d) The coupler or shroud allows an expansion of a plurality of pergola kits to be easily assembled together as one expanded kit system.

(e) The reinforced beam support member allows long spans of beams and joists, while providing an area within the beam for tap-lock pins to engage with for easy assembly of a pergola kit system.

(f) The pergola system provides a building structure that is well connected, maintenance friendly, and easily installed.

(g) The pergola system has connection means at combined part location that unite the system even under extreme weather conditions.

The tap-lock pin and assembly system can be used readily in shade structure applications as well as other uses, such as installing fence boards horizontally, or vertically, installing completely water tight or water resistant ceilings, or installing roof structures using the same type tap-lock or clip tap-lock with mating or prepared extrusions. Tap-lock pin 56 can also be used to hold two flat surfaces of a given thickness together by pushing the tap-lock pin through a predrilled surface for connection. Furthermore, the tap-lock and assembly system has additional advantages in that

- it provides a continuous, homogeneous unit that is easy to install;
- it permits the exposed surfaces of the pergola to be free of unsightly fasteners that detract from the aesthetic look of the overall structure;
- it permits superior beam and joist reinforcement that allows long spans;
- it permits a great deal of flexibility for the arrangement of posts to a substrate allowing adaptability for a multitude of cantilevered conditions;
- it provides an interengagement of a plurality of clips which simplifies assembly of components to those unskilled in the art and
- it provides a vast array of geometrically shaped shade cover kits which aesthetically flow freely while providing connecting points for positive attachments.

RAMIFICATIONS AND SCOPE

Although the description above contains many specificities, these should not be construed as limiting the scope of the invention but merely providing illustration of some of the presently preferred embodiments. Other embodiments are possible. For example, the clip tap-lock ends can be made to butt end to end rather than engage each other. A side portion can be added at right angles which rest along the side of the joist for alignment or attachment for a water shed type application. Deformations or protrusions on the side or bottom portion of the clip can be added which will attach secure or fasten the clip to a substrate. An elongated hollow extrusion can be manufactured with an inner elongated web member which stops the reinforced beam engagement ends 60 and 60A of tap-lock 56 from traveling deeper into the elongated extrusion due to the inner web. Engagement ledges 48, 48A, 48B, and 48C then engage the outer wall at routered hole location.

Also, extrusion hollow profiles can be made to desired thicknesses so that tap-lock pin 56 dead ends and engages without the need for a center standoff, as with the alternative tap-lock pin of FIG. 10. Extrusion hollow profiles can be made with triangular shapes which, when attached to joists as with the currently explained pergola system, can provide a lighter top structure. It will also create a top structure where snow load may be substantially reduced due to the A-frame shape of the horizontal strip, such as with a winter home style roof.

A rounded extrusion with a surface wide enough to allow tap-lock pin 56 to be received is possible in many forms. Rounded surfaces that have an elongated recess that can capture a flange configuration can join the parts together in accordance with the teachings of this invention.

Extrusions can be shaped to provide a water-resistant top surface so the pergola not only provides shade, but would also channel water to its outer perimeters. The water can flow into gutters for a water shedding system. Snapping the tap-lock together with such an extruded profile is generally the same in all respects. Clips can be configured with flanges that grab extrusion shapes from the outside perimeter surfaces in a multitude of ways. These alternative embodiments use the principles of the invention.

A house-ledger connection (FIG. 23) can obviously be substituted for one beam and two posts of a four-post, free-standing system, making it an attached system rather than freestanding. The ledger serves as the beam support and the joist can either be mounted on top of the ledger similar to the beam-to-joist connection or the joist can be attached to the ledgers face by standard joist hangers. The attached system requires only two knee braces 29 (FIG. 22) at the post-to-beam connections to prevent sway of the pergola posts. The attachment to the building incorporates stability and allows six knee braces to be eliminated.

Many forms of alternative engagement ends can be configured, such as with a puzzle, lap over, finger joint, dove tail, tongue-and-groove connections, and the like. These provide the same connection function but with differing shapes.

Various heights, depths, or widths of the horizontal strips are possible. The number of recesses with means for attachment can be altered simply to produce alternative embodiments. Clips with flanges can be configured in a plurality of shapes or number of flanges. The direction of flanges can vary, yet still mate effectively with horizontal strips. A round, mushroom-shaped flange with a conical head and ledge for engagement can be made to connect building parts, allowing connection from 360°. It also allows free form construction to occur and enables mating with the horizontal strip, yet the basic function and simplicity remains unchanged.

Materials, such as composites, can be extruded with differing shapes that can imitate and implement the system as discussed. Metal, wood, wood inlays, fiberglass, minerals, organics, inorganics, as well as many plastics, can be manufactured in various shapes, sizes, profiles, machined, roll formed, pultruded, extruded, injection molded, cast, or stamped. These techniques are all well known and can be manufactured with this system's advantages and equivalent results.

Therefore, the scope should be determined by the appended claims and their equivalents, and not by the examples given.

The invention claimed is:

1. A pergola formed from building members, comprising, (a) at least two horizontally disposed beams, each of said beams having a hollow axis and extending in a first direction, (b) at least four vertical posts disposed under opposite portions of said horizontally disposed beams, said vertical posts supporting said beams and extending in a second direction perpendicular to said beams, (c) means interconnecting said horizontally disposed beams and said vertical posts, (d) at least two generally horizontally disposed joists interconnecting said beams, positioned above said beams, and supported by said beams, each joist having an upper surface and a hollow axis and extending in a third direction perpendicular to said beams and said posts, (e) at least two horizontally disposed horizontal strips interconnecting said joists, positioned above said joists, and supported by said joists, said horizontal strips resting upon the upper surfaces of said joists and extending in said first direction, (f) at least two beam support stiffeners positioned inside the respective hollow axes of said respective beams, said support stiffeners extending for substantially the entire length of said beams so as to support and stiffen said beams throughout substantially their entire lengths, and (g) at least two joist support stiffeners positioned inside the respective hollow axes of said respective joists, said support stiffeners extending for substantially the entire length of said beams so as to support and stiffen said joists throughout substantially their entire lengths, (h) whereby said building members comprise a continuous, homogeneous, robust, and lightweight unit that may be extended indefinitely with additional posts, beams, and joists, (i) said pergola further containing:

(j) at least two additional vertical posts, (k) at least two additional horizontally disposed beams connected to and supported by said two additional vertical posts in a manner similar to the connection of said four vertical posts and said two horizontally disposed beams, (l) at least one additional joist connected to and supported by said two additional horizontally disposed beams in a manner similar to the connection of said two joists and said two horizontally disposed beams, and (m) at least one additional horizontal strip connected to and supported by said one additional joist in a manner similar to the connection of said two joists and said two horizontally disposed strips, (n) said two additional posts being aligned with said four vertical posts and connecting said two additional horizontally disposed beams with bolts, (o) said two additional horizontally disposed beams and one additional joist having hollow axes and containing internal stiffeners similar to those of said two joists and said two horizontally disposed beams, (p) said additional joist connected to said two additional horizontal beams with a bracket, and (q) means for attaching said bracket to both said additional joist and said two additional horizontal beams, (r) whereby said additional building members will extend the length of said pergola, (s) said additional horizontal strip having a shroud on a first end thereof and a pin for interconnecting a second end of said additional horizontal strip with said additional joist, and (t) further including at least one pair of flanges on at least one end of said pin, (u) whereby said additional horizontal strip interconnects said additional joist with said additional horizontal strip, and said additional horizontal strip connects at least one of said generally horizontally disposed joists with said shroud and connects a second end on said additional joist with said pin.

2. The pergola of claim 1, further comprising at least two knee braces and means connecting said knee braces to two of said posts and two of said beams, respectively.

3. The pergola of claim 1 wherein said further including interconnecting means on said support stiffeners positioned inside the hollow axes of said respective joists for receiving an attachment pin.

4. A pergola formed from building members comprising:

(a) a plurality of vertical posts, (b) a plurality of horizontal beams supported by said posts and extending perpendicularly to said posts, (c) a plurality of horizontal joists above said beams and supported by said beams and extending perpendicularly to said beams and said posts, (d) a plurality of clips for attachment to said respective joists and for connection to a plurality of horizontal strips above said joists, (e) each of said clips having a bottom portion which is attached to its respective joist, said bottom portion having a pair of opposite ends which define the length of said bottom portion, (f) each clip having at least one tap-lock pin connector extending up from a center section of said bottom portion, each tap-lock pin connector having an upper end having push-lock attachment means thereat, and (g) a plurality of elongated horizontal strips extending parallel to said beams, (h) each of said horizontal strips having an upper surface and an undersurface and a pair of opposite sides connecting said upper surface to said undersurface, said opposite sides defining the width of said horizontal strip, said undersurface of said horizontal strip having an elongated aperture which extends along the length of said horizontal strip, and (i) each of said elongated apertures having a means for mating with said tap-lock pin connectors so that when said elongated aperture of said horizontal strips is pushed onto said tap-lock pin connector, said tap-lock pin connector will mate with said aperture and connect said strip to said clip, (j) whereby said horizontal strip will engage said clip securely when said horizontal strip is pushed down onto said clip and whereby said building members comprise a continuous, homogeneous, robust, and lightweight unit that may be extended indefinitely with additional posts, beams, and joists.

5. The pergola of claim 4, further comprising at least two knee braces and means connecting said knee braces to two of said posts and two of said beams, respectively.

6. The pergola of claim 4 wherein said joists are hollow and have a plurality of support stiffeners positioned inside said respective joists for stiffening and reinforcing said joists.

* * * * *